US005184812A

United States Patent [19]

Namba

[11] Patent Number: 5,184,812

[45] Date of Patent: Feb. 9, 1993

[54] SHEET FEEDING APPARATUS CAPABLE OF FEEDING SHEETS OF PLURAL SIZES

[75] Inventor: Toyoaki Namba, Nara, Japan

[73] Assignee: Sharp Kabushiki Kaisha, Osaka, Japan

[21] Appl. No.: 697,329

[22] Filed: May 8, 1991

[30] Foreign Application Priority Data

May 9, 1990 [JP] Japan ..... 2-120965

[51] Int. Cl.[5] ..... B65H 3/08

[52] U.S. Cl. ..... 271/98; 271/108

[58] Field of Search ..... 271/94, 97, 98, 99, 271/105, 108

[56] References Cited

U.S. PATENT DOCUMENTS

| | | | |
|---|---|---|---|
| 3,198,514 | 8/1965 | Barbara et al. . | |
| 4,418,905 | 12/1983 | Garavuso . | |
| 4,518,159 | 5/1985 | Nishibori et al. | 271/106 |
| 4,566,683 | 1/1986 | Moore | 271/98 |
| 4,585,222 | 4/1986 | Nishibori et al. | 271/106 |
| 4,887,805 | 12/1989 | Herbert et al. | 271/94 |
| 5,519,859 | 5/1980 | Kikuchi . | |

FOREIGN PATENT DOCUMENTS

| | | | |
|---|---|---|---|
| 254438 | 11/1986 | Japan | 271/97 |
| 254439 | 11/1986 | Japan | 271/97 |
| 117139 | 5/1989 | Japan | 271/98 |
| 187137 | 7/1989 | Japan | 271/96 |

*Primary Examiner*—Robert P. Olszewski
*Assistant Examiner*—Steven M. Reiss
*Attorney, Agent, or Firm*—David G. Conlin; Robert F. O'Connell; Donald R. Castle

[57] ABSTRACT

Air flows are jetted at leading edge of sheets from nozzles aligned along the widthwise direction of the sheets so as to separate the bottommost or uppermost sheet from the remaining sheets. When the sheets are large-sized, all the aligned nozzles form the air flows for separating the sheets. When the air flows from all the nozzles are jetted at the small-sized sheets, the sheets are liable to flap. Accordingly, the nozzles arranged near the both ends are closed, so that only the nozzles jetting the air flows to effectively separate the small-sized sheets are used.

6 Claims, 32 Drawing Sheets

SHEET FEEDING APPARATUS CAPABLE OF FEEDING SHEETS OF PLURAL SIZES

BACKGROUND OF THE INVENTION

1. Field of the Invention

The present invention relates to a sheet feeding apparatus for feeding one sheet each by separating from a stacked state of sheets, regardless of the sheet size, when sheets of single-form documents or recording paper are used in plural sizes in a copying machine or the like.

2. Description of the Prior Art

In a copying machine equipped with a recirculating document handler (RDH) for stacking up documents of single form in a plurality, separating and feeding the documents one by one from the top side or bottom side, and returning to the stacked position after reading the documents in the bottom side or top side, a sheet feeder is used, such as the feeding apparatus of documents and the feeding apparatus of separating and feeding the stacked recording sheets one by one. In printing apparatus and photographic printing device, too, an apparatus for separating and feeding stacked recording papers is employed. In such paper feeding device, it is necessary to separate the stacked sheets one by one, and various separating methods are known, such as the air flow separating method, separating claw method, and method for separating sheets by using a roller rotating in a reverse direction of sheet feeding direction.

As an example of the prior art of separating sheets by using air flow, the structure of a paper feeder is shown in FIG. 1, a side view, and in FIG. 2, a plan view. This composition is, for example in a copying machine of RDH method, a paper feeder 1 for feeding by separating the stacked recording papers one by one. The paper feeder 1 is provided with a support tray 3 on which recording papers 2 are stacked up.

At the downstream side of the feeding direction A1 of the recording paper 2 and near the middle of the widthwise direction of the support tray 3 intersecting with the feeding direction A1, a notch 4 is formed, and a feed belt 7 stretched on a pair of rotating rollers 5, 6 disposed beneath the support tray 3 and having many penetration holes formed is exposed at this notch 4. Between the rotating rollers 5, 6 is arranged an air intake duct 8 opposite to the notch 4 across the feed belt 7, and the recording paper 2 on the support tray 3 is attracted by vacuum to the feed belt 7, and is fed in the feeding direction A1 by running and driving of the feed belt 7.

On the other hand, since there is a possibility that plural recording papers 2 on the support tray 3 be attracted and fed together by the feed belt 7, an air injection duct 9 is disposed above the downstream side of the feeding direction A1 from the support tray 3, and nozzles 10*b* to 10*e* parallel to the feeding direction A1 are communicated with one another.

At this stage, in order to improve capability of separating relatively large-sized recording papers 2, the array width L11 of the nozzles 10*b* to 10*e* disposed in the direction perpendicular to the feeding direction may be extended. In such a case, when the recording paper 2 having a width of smaller than the array width L11 is fed, the air flows from the nozzles 10*b*, 10*e* are passed without meeting the upstream ends of the recording papers 2, thereby flapping the lateral ends 2*a*, 2*b* of the recording paper 2. In this case, the stacking state of the recording papers 2 stacked within the paper feeder 1 is disordered which may in turn result in duplicate feed or feeding failure of the recording papers 2. Also in the case where the recorded papers 2 to be used are relatively small-sized, the sheet separating capability by the air flows from the nozzles 10*b* to 10*e* becomes excessive and thereby the small-sized recording papers are liable to be dispersed within the paper feeder 1.

In order to prevent such occurrences, the array width L11 may be reduced. In such a case, the area of a separation region 17, which is created by the air from the air injection duct 9 entering between the recording papers 2 and separating the recording papers 2 one from another, becomes relatively smaller compared with a non-separation region 18 in which the recording papers 2 are mutually stuck together. Accordingly, when the bottommost recording paper 2 is fed with being vacuum attracted to the feed belt 7, there are cases in which the duplicate feed may occur due to the friction in the non-separation region 18.

"Sheet feeding apparatus" disclosed in Japanese Laid-open Patent No. 58-78932 is given as another example of the prior art. U.S. Pat. No. 3,198,514 and Japanese Patent Publication No. 55-19859 respectively disclose similar configurations to the one of the invention. Such configuration is shown in a top plan view of FIG. 3. This configuration is similar to the one of the foregoing prior art and like reference numerals designate like or corresponding parts.

In this prior art, in addition to the nozzles 10*b* to 10*e* arranged in parallel to the feeding direction A1 in the foregoing embodiment, a plurality of nozzles 10*a*, 10*f* directed substantially at the widthwise center of the recording paper 2 are arranged outside the nozzles 10*b* to 10*e* in the array direction thereof with all the nozzles communicating with one another. Even the prior art thus constructed has similar drawbacks as the foregoing prior art.

Accordingly, in the case where the recording papers are limited to predetermined types, each of the foregoing prior arts demonstrates relatively satisfactory sheet separating capacity. However, in terms of versatility of effectively separating the recording paper sheets of a wide variety of sizes or quantities, the prior arts do not demonstrate sufficient versatility since they are liable to meet a sheet separation failure or feeding failure. Accordingly, a sheet feeding apparatus is desired which has capability of effectively separating the recording paper sheets of a wide range of sizes and quantities.

SUMMARY OF THE INVENTION

The invention has an object of overcoming the aforementioned technical drawbacks and providing an improved sheet feeding apparatus for feeding the sheets of a plurality of sizes, the sheet feeding apparatus having a function of effectively separating the sheets with successfully corresponding to the sizes or quantity of the sheets.

The present invention provides a sheet feeding apparatus for feeding sheets of plural sizes characterized in that the sheet feeding apparatus comprising:

a laying plate on which a plurality of sheets are stacked;

a feeding means disposed either above or below the sheets for vacuum attracting either the bottommost sheet or the uppermost sheet of the stacked sheets and feeding the vacuum attracted sheet;

air flow forming means disposed downstream of the laying plate with respect to the feeding direction for jetting a plurality of air flows at the feeding means and near the downstream end portion of the stacked sheets in the widthwise direction of the laying plate; and air flow control means for selectively controlling the rate of one or more of plural outer air flows arranged in the widthwise direction of the laying plate.

According to the invention, either the bottommost or the uppermost sheet of plural sheets stacked up on the laying plate is vacuum attracted and fed by the feeding means. At this time, in order to prevent plural sheets from being fed at the same time, the stacked sheets are separated up and down by the air jetted from the air flow forming means. The air flow forming means is disposed downstream of the laying plate with respect to the feeding direction, i.e. forwardly thereof, for forming a plurality of air flows in the widthwise direction of the laying plate.

Here, the air flow control means selectively controls the rate of one or more of plural outer air flows arranged in the widthwise direction of the laying plate. Thereby, in the case where the width of the sheet to be fed in the direction normal to the feeding direction is relatively small, the air flow control means reduces the rate of any of plural outer air flows arranged in the widthwise direction of the laying plate, thereby preventing the stacking state of the sheets having a small width from being disordered. Further, in the case where the sheet having a large width is to be fed, the air flow control means maximizes the rate of any of the outer air flows in the widthwise direction. Moreover, in the case where the sheet having an medium width between the large and small width is to be fed, the air flow control means reduces the rate of a portion of plural outer air flows.

In this manner, the invention is made capable of reliably feeding one by one the sheets of a variety of sizes, from the ones having small widths to the ones having large widths.

As described above, according to the invention, the air flow control means selectively controls the rate of one or more of plural outer air flows arranged in the widthwise direction of the laying plate. Thereby, in the case where the width of the sheet to be fed in the direction normal to the feeding direction is relatively small, the air flow control means reduces the rate of any of plural outer air flows arranged in the widthwise direction of the laying plate, thereby preventing the stacking state of the sheets having a small width from being disordered. Further, in the case where the sheet having a large width is to be fed, the air flow control means maximizes the rate of any of the outer air flows in the widthwise direction. Moreover, in the case where the sheet having an medium width between the large and small width is to be fed, the air flow control means reduces the rate of a portion of plural outer air flows.

In this manner, the invention is made capable of reliably feeding one by one the sheets of a variety of sizes, from the ones having small widths to the ones having large widths.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
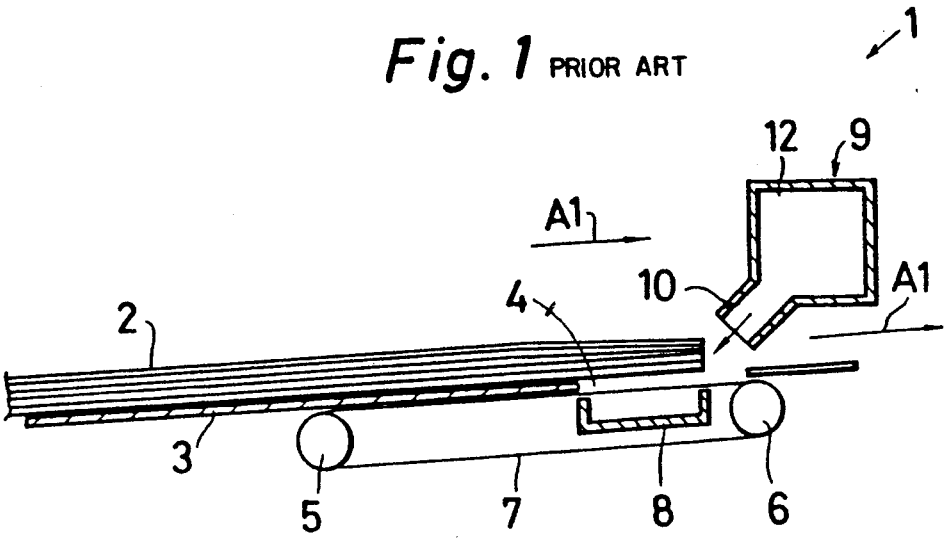
Fig. 1 PRIOR ART
FIG. 1 is a side view of a paper feeder 1 of an exemplary prior art.
Figure 2:
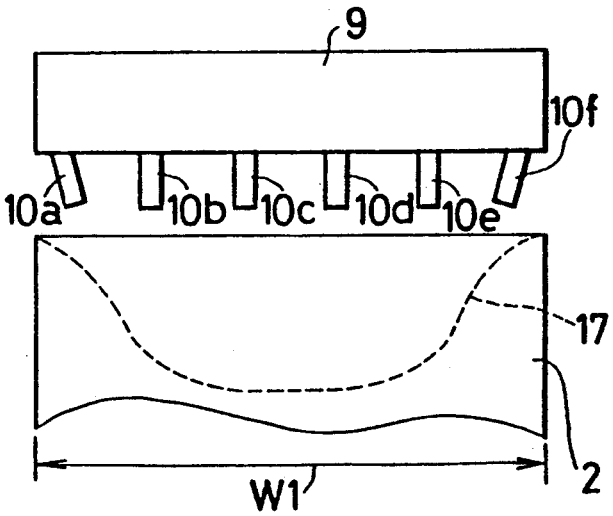
Fig. 2 PRIOR ART
FIG. 2 is a cross sectional view illustrating an arrangement of an air injection duct 9 and nozzles 10 for use in the paper feeder 1.
Figure 3:
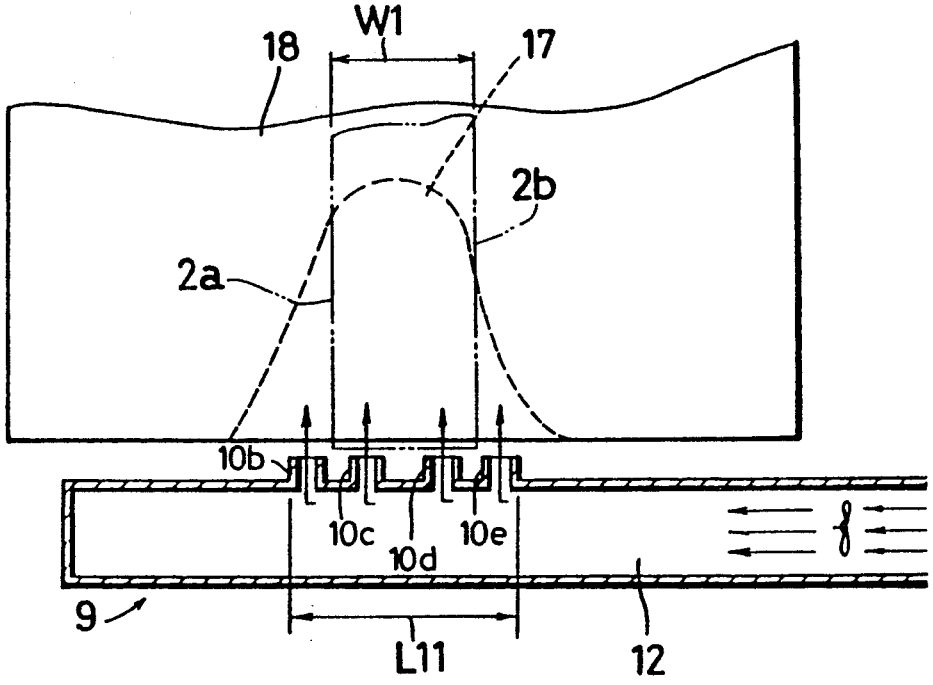
Fig. 3 PRIOR ART
FIG. 3 is a plan view illustrating a state of an air flow in the prior art.

Now referring to the drawing, preferred embodiments of the invention are described below.

Figure 4:
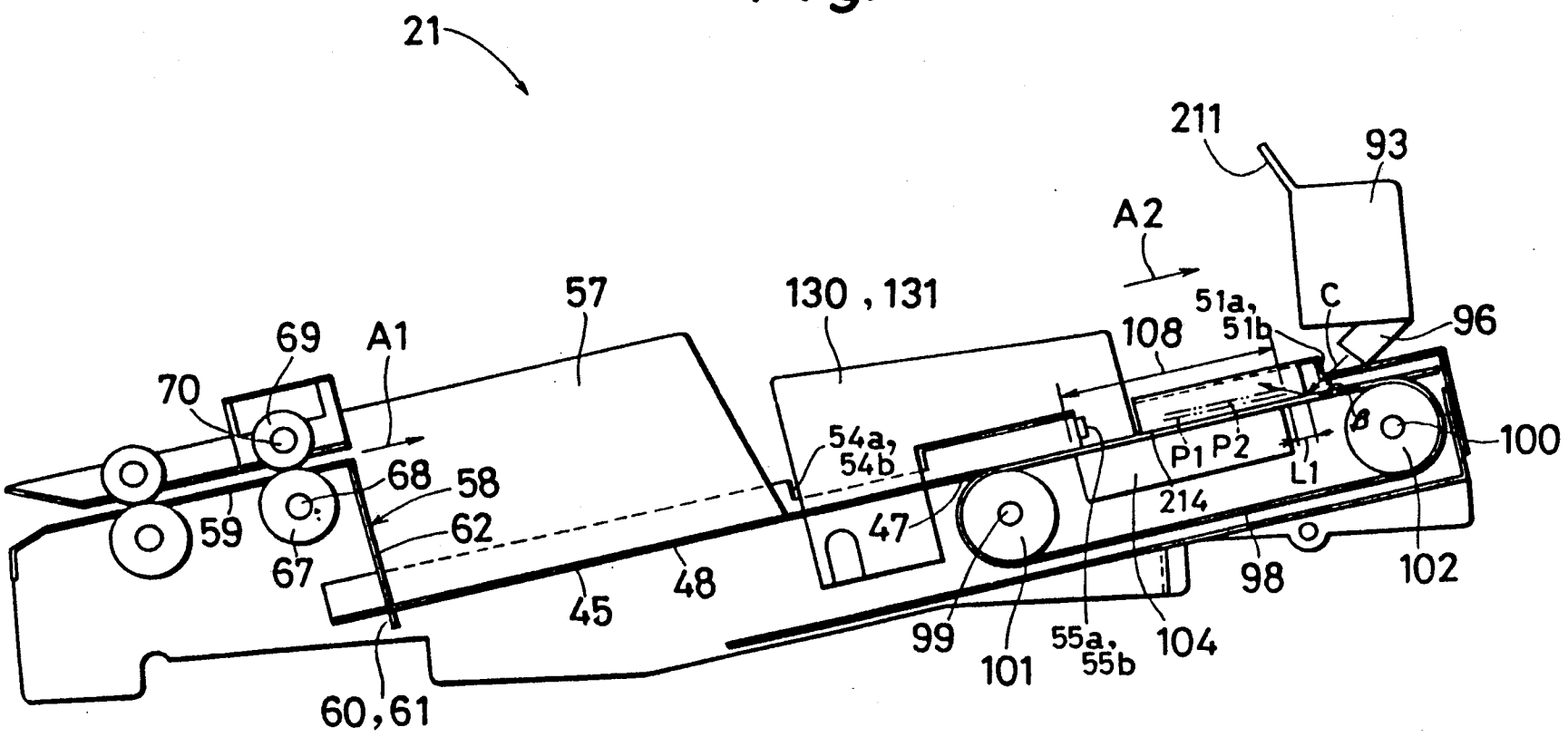
FIG. 4 is a cross sectional view of a paper feeder 21 embodying a basic configuration of the invention.
Figure 5:
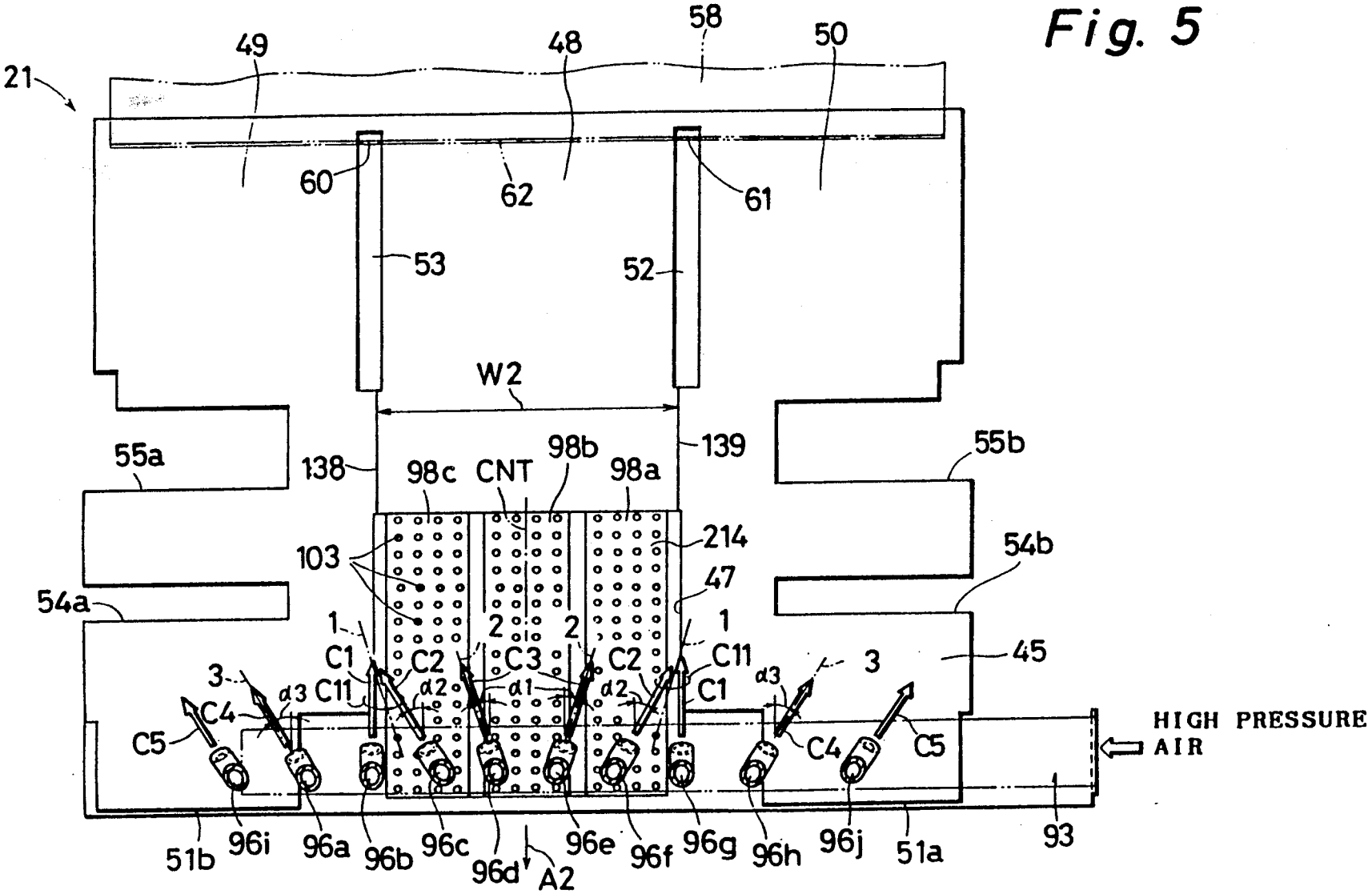
FIG. 5 is a top plan view of the paper feeder 21.
Figure 6:
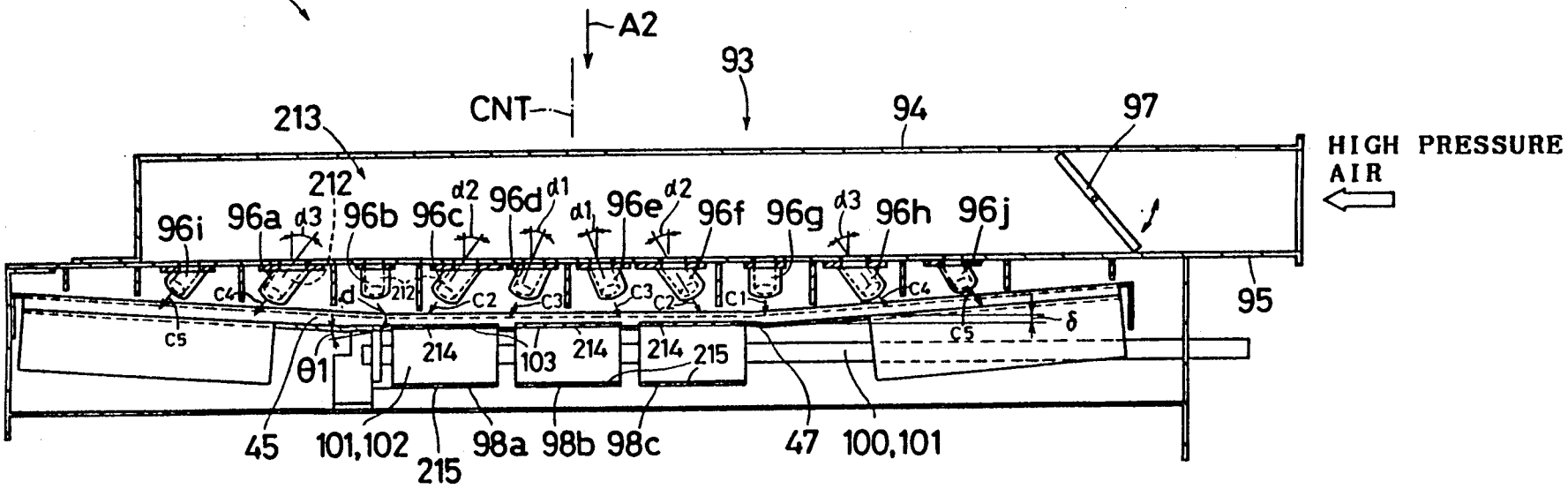
FIG. 6 is a side view of the paper feeder 21.
Figure 7:
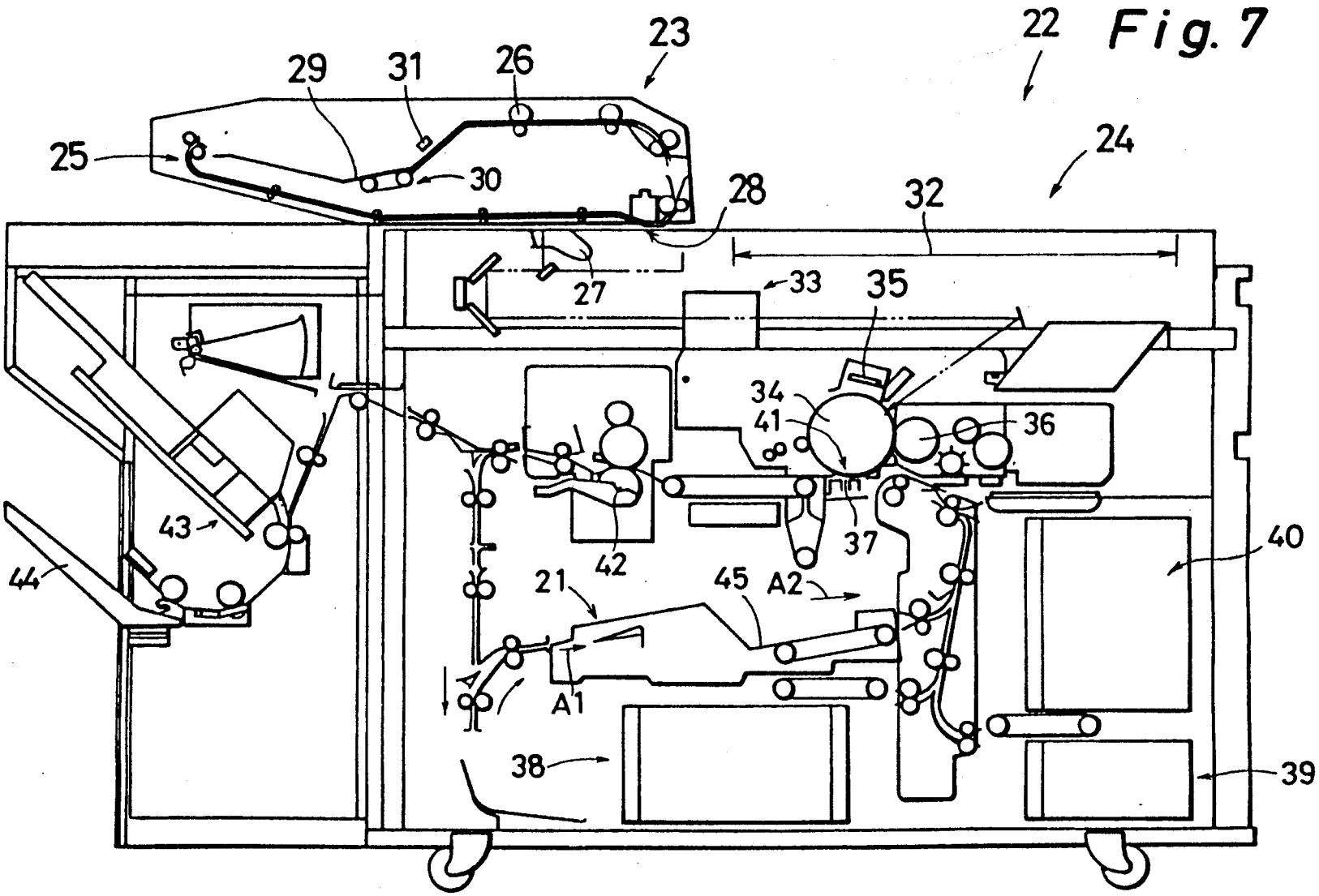
FIG. 7 is a cross sectional view of a copying machine 22 provided with the paper feeder 21.

FIG. 4 is a side view showing a section of a paper feeder 21 called an intermediate tray in a basic configuration of the invention, FIG. 5 is a plan view of the paper feeder 21, FIG. 6 is a front view thereof, and FIG. 7 is a sectional view of a copying machine 22 employing such paper feeder 21. The copying machine 22 comprises a recirculating document handler unit (hereinafter called RDH unit) 23, and a main body 24. The RHD unit 23 has a document feeder 25 of so-called bottom-take top-return system, and the taken document is exposed in an exposure region 28 by a light source 27 while being conveyed through a conveying route 26, and is returned to the document feeder 25. The document feeder 25 comprises a document laying plate 29, paper feeder 30, and air injection unit 31.

The main body 24 has the light source 27 in its inside, and an exposure region 28 of the RDH unit 23 by the light source 27 and an exposure region 32 of the main body 24 are set. The document reflected light beams from the exposure regions 28, 32 are focused on a photosensitive drum 34 through an optical system 33. Around the photosensitive drum 34 are arranged a charger 35, a developer 36, and a transfer unit 37, and recording papers of various sizes are supplied from three paper feeders 38, 39, 40 to the transfer region 41 between the transfer unit 37 and the photosensitive drum 34, and the document images by the document reflected light are recorded. The recording papers after transfer are fixed in a fixing unit 42, and filed in every specified number of pieces in a bundling unit 43, and stored in a discharge tray 44.

In the paper feeder 21, the copied recording papers are carried in the direction of arrow A1, and fed along the direction of arrow A2. The laying plate 45 of the paper feeder 21 which is explained below is positioned at an inclination of, for example, 10.4 degrees to the horizontal direction so that the upstream side may be lower than the downstream side of the paper feeding direction A2 with respect to the horizontal direction.

Figure 8:
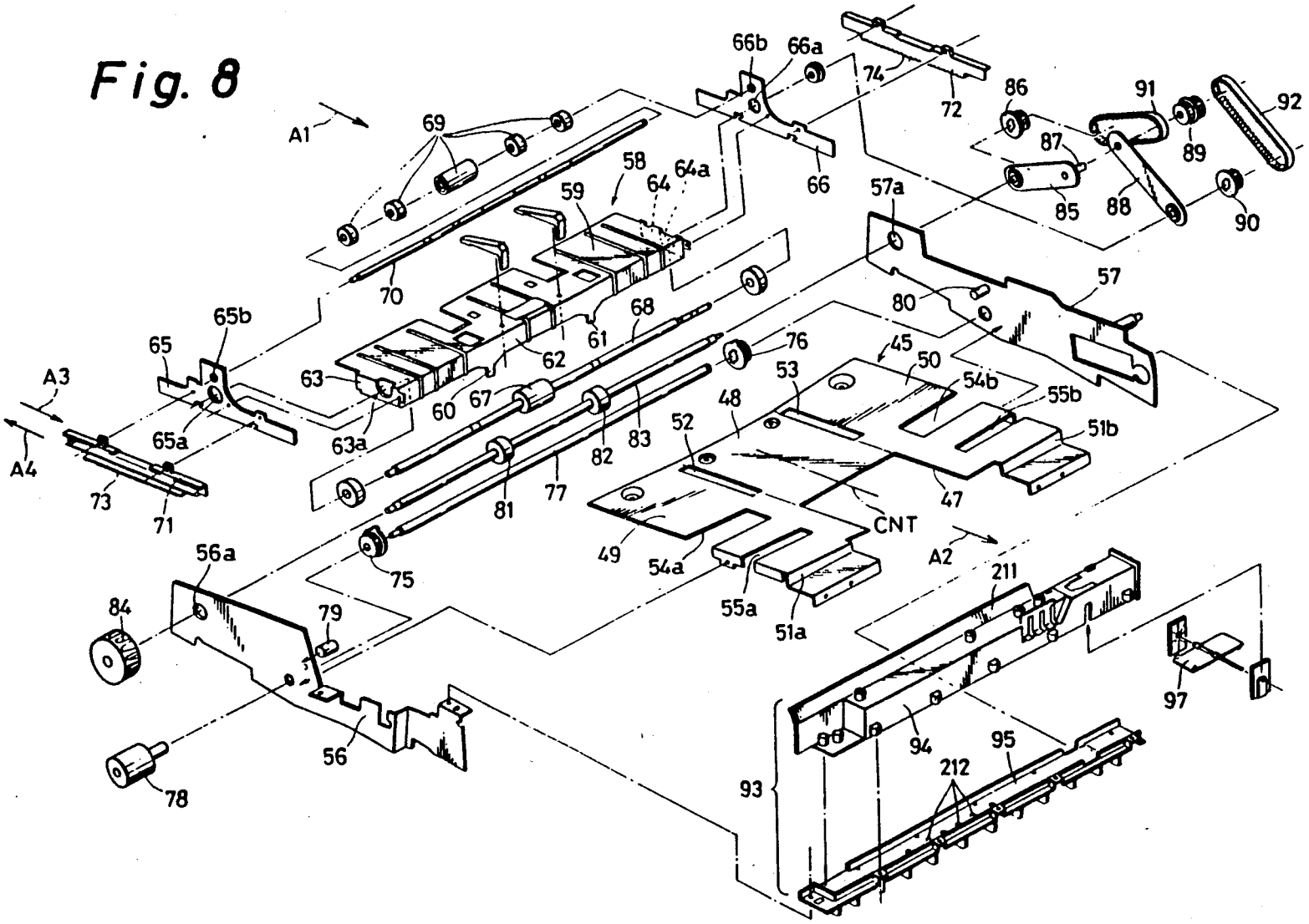
FIGS. 8 and 9 are exploded perspective views of the paper feeder 21.
Figure 9:
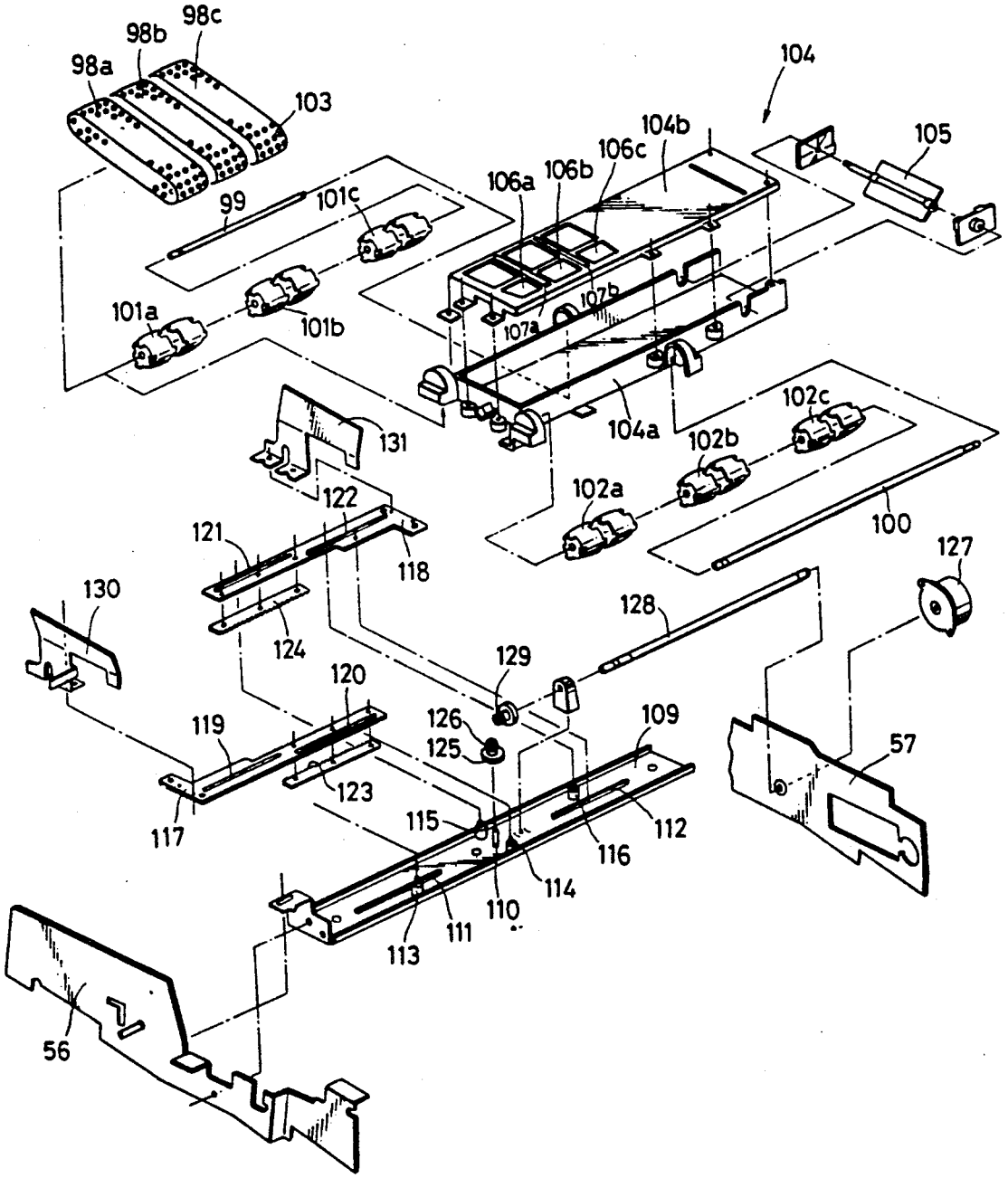

FIG. 8 and FIG. 9 are exploded perspective views of the paper feeder 21. Referring also to FIG. 4 to FIG. 6, the paper feeder 21 is described below. The paper feeder 30 of the document feeder 25 is composed basically same as the paper feeder 21 described below. The paper feeder 21 comprises the laying plate 45 on which the recording papers conveyed in the conveying direction A1 are stacked up. A notch 47 is formed in this laying plate 45, and the upper stretching parts of the belts 98*a*, 98*b* and 98*c* (collectively indicated by numeral 98 where necessary) stretched for feeding the recording paper mounted fro composing the feeding means together with the laying plate 45 are opposite to the recording paper upward, and are exposed through this notch 47.

The laying plate 45 comprises a central laying part 48 having a predetermined length W2 in the widthwise direction orthogonal to the recording paper feeding direction A2, and lateral laying parts 49, 50 formed by plastically folding so as to be bent upward along the widthwise outward direction by forming an angle of $\theta 1$ to the central laying part 48 integrally communicating with the both ends in the widthwise direction of the central laying part 48. The lateral laying parts 49, 50 are extended longer than the central laying part 48 toward the downstream side of the feeding direction A2, and downward drooping stepped parts 51*a*, 51*b* are formed near the end parts thereof. A pair of parallel slots 52, 53 are formed along the paper feeding direction A2 in the laying plate 45, and pairs of slots 54*a*, 54*b*, 55*a*, 55*b* are formed in the same direction in the individual lateral laying parts 49, 50. Such laying plate 45 is formed symmetrically to the widthwise central position CNT. The laying plate 45 is screwed to the lateral plates 56, 57 at both ends in the widthwise direction.

At the upstream side of the paper feeding direction A1 of the laying plate 45, a rear end defining member 58 is disposed. The rear end defining member 58 communicates with a guide plate 59 for guiding the recording paper delivered along the conveying direction A1 by supporting from beneath, and the downstream side of the conveying direction A1 of the guide plate 59, and comprises a defining plate 62 having slots 52, 53 formed in the front ends, forming guide pieces 60, 61 slidable along the longitudinal direction of the slots 52, 53, contacting against the upstream side end part of the paper feeding direction A2 of the recording papers stacked up on the laying plate 45, and aligning the upstream side end parts of the stacked-up recording papers.

As mentioned above, the laying plate 45 is composed so that the upstream side of the paper feeding direction A2 may be lower than the downstream side with respect to the horizontal direction. Therefore, as shown in FIG. 4, the recording paper delivered in the arrow A1 direction onto the laying plate 45 by the rollers 67, 69 slides to the downstream side of the paper feeding direction A2 on the laying plate 45, and collides against a collision plate 211 of, for example, a draft duct 93 mentioned below and stops, and returns to the upstream side of the paper feeding direction A2 due to the slope stated above, that is, to the rear end defining member 58 side, and stops by contacting against the defining plate 62 of the rear end defining member 58. In this way, the upstream side end portions of the feeding direction A2 of the recording papers stacked up on the laying plate 45 are aligned, and hence the downstream side end portions of the feeding direction A2 of the recording papers having the same shape are also aligned.

At both ends in the widthwise direction of the guide plate 59, side plates 63, 64 are drooping and formed, and mounting plates 65, 66 are affixed to the side plates 63, 64, respectively. In the side plates 63, 64 and mounting plates 65, 66, coaxial mounting holes 63*a*, 64*a*, 65*a*, 66*a* are formed, and a rotary shaft 68 on which the roller 67 is fixed is free to rotate and penetrate. In the mounting plates 65, 66, furthermore, mounting holes 65*b*, 66*b* are formed above the mounting holes 65*a*, 66*a*, and a rotary shaft 70 on which plural rollers 69 are fixed is free to rotate and penetrate.

On the mounting plates 65, 66, driving members 71, 72 with an approximately C-section in the section orthogonal to the longitudinal direction are fixed with the open ends directed outward in the widthwise direction. At the lower end parts of the driving members 71, 72, racks 73, 74 are formed along the longitudinal direction. On the side plates 56, 57, a rotary shaft 77 on which pinions 75, 76 to be engaged with the racks 73, 74 at both ends is rotatably mounted, and is rotated by a pulse motor 78.

At the located positions of the driving members 71, 72 in the side plates 56, 57, the rotary rollers 79, 80 are rotatably installed, and the driving members 71, 72 are composed so as to contain the rotary rollers 79, 80 therein, respectively. Therefore, the driving members 71, 72 are supported so as not to fall downward by the rotary rollers 79, 80, and are free to slide easily along the longitudinal direction. That is, by the pulse motor 78, as the rotary shaft 77, hence, pinions 75, 76 are put into rotation, the driving members 71, 72 are displaced reciprocally in the direction of arrows A3, A4 along the longitudinal direction thereof, so that the rear end defining member 58 may be displaced reciprocally to the downstream side and upstream side of the feeding direction A2.

The mounting holes 56*a*, 57*a* are formed in the side plates 56, 57, and the rotary shaft 83 on which the rollers 81, 82 are fixed is free to rotate and penetrate. The rotary shaft 83 is manually rotated by a knob 84 affixed to this shaft. The opposite side to the knob 84 of the rotary shaft 83 is fixed to a gear 86 by rotatably penetrating one end of the longitudinal direction of the coupling plate 85 formed slenderly. On the opposite side of the coupling plate 85, a pivot 87 is projecting toward the outside of the widthwise direction, and is rotatably inserted into one end in the longitudinal direction of a coupling plate 88 in the same shape as the coupling plate 88, and is further fixed in a gear 89. At the other end of the coupling plate 88, one end of the rotary shaft 68 is rotatably inserted to be fixed with the gear 90. Between the gears 86, 89, a tiny belt 92 is stretched, and between the gears 89, 90, a timing belt 92 is stretched.

That is, when the knob 84 is turned by hand, the rotary shafts 68, 83 rotate in synchronism even if the rear end defining member 58 on which the rotary shaft 68 is mounted is at an arbitrary position along the conveying direction A1, so that jamming may be cleared.

At the downstream side of the feeding direction A2 of the laying plate 45, a nozzle member 93 fixed to the side plates 56, 57 is disposed as being stretched in the widthwise direction. The nozzle member 93 is composed of a main body 94 forming a bottomless box longitudinal in the widthwise direction, and a cover body 95, and an air passage 213 is formed inside. The cover body 95 has nozzles 96*a* to 96*h* having nozzle holes 212, respectively formed in plural pairs at symmetrical positions with respect to the widthwise direction central position CNT of the laying plate 45, and draft/stop is realized to the laying plate 45 by the angular displacement state of a damper 97 installed in the nozzle member 93.

Beneath the laying plate 45, three feeding stretch belts 98*a*, 98*b*, 98*c* are disposed, for example, opposite to the notch 47, and they are stretched between the driving rollers 101*a*, 102*a*; 101*b*, 102*b*; 101*c*, 102*c* fixed on the rotary shafts 99, 100, respectively.

At the upper ends of the feeding stretch belts 98*a* to 98*c*, between the upper stretching portion 214 forming the paper feeding surface and the central laying part 48 of the laying plate 45, a step difference of height $\delta$ is set so that the upper stretching part 214 of the feeding stretch belts 98*a* to 98*c* may be lower as shown in FIG. 6. This step difference height $\delta$ is selected in a range of 1 to 5 mm, or preferably about 2 mm. The step difference height $\delta$ is, as described in detail below, intended to produce a gap to the second recording paper from the bottom by deflecting downward by the step difference height $\delta$ from the central laying part 48 of the laying plate 45, when the lowest recording paper of the stack of the recording papers P on the laying plate 45 is attracted in vacuum to the feeding stretch belts 98*a* to 98*c*, thereby separating smoothly. Accordingly, if the step difference height $\delta$ is too small, the separating capacity is insufficient, or if excessive, attracting of the recording paper to the feeding stretch belts 98*a* to 98*c* is insufficient, and conveying failure may occur.

In the feeding stretch belt 98, multiple penetration holes 103 are formed as the air vent holes, and inside the feeding stretch belt 98 there is a vacuum attracting box 104 for attracting in vacuum the recording paper by negative pressure on the feeding stretch belt 98 through the penetration holes 103. The vacuum attracting box 104 is composed of a box-shaped main body 104*a* and a cover body 104*b*, and attracting holes 106*a* to 106*c* are formed in the cover body 104*b* at positions corresponding to the feeding stretch belts 98*a* to 98*c*. Among the attracting holes 106*a* to 106*c* there are formed protrusions 107*a*, 107*b* extending along the feeding direction A2, and they are selected at a height projecting higher than the upper stretching part 214, among the feeding stretching belts 98*a* to 98*c*. The vacuum attracting box 104 is connected to a vacuum source (not shown), and executes and stops the attracting action of the recording paper by the angular displacement action of the damper 105 contained inside.

As shown in the plan view in FIG. 5, the nozzles 96*b*, 96*g* possessing a second nozzle hole for forming an air injection flow C1 parallel to the feeding direction A2 are composed parallel to the feeding direction A2 in a plan view. The angle $\alpha 2$ of the nozzles 96*c*, 96*f* having a first nozzle hole forming an injection flow C outward in the widthwise direction colliding against the injection flow C1 formed with the feeding direction A2 in a plan view is 20 to 45 degrees, or preferably selected around 30 degrees. Concerning the air flow C11 combining these injection flows C1, C2, the central line $\phi 1$ of each air flow is assumed.

The angle $\alpha 1$ of the nozzles 96*d*, 96*e* forming an injection flow parallel to the central line $\phi 2$ outward in the widthwise direction and an air flow C2, inward in the widthwise direction from the nozzles 96*c*, 96*f*, formed with the feeding direction A2 in a plan view is 0 to 45 degrees, or preferably selected around 15 degrees. Besides, the angle $\alpha 3$ of the nozzles 96*a*, 96*h* forming an injection flow parallel to the central line $\phi 3$ outward in the widthwise direction and an air flow C4, disposed outward in the widthwise direction of the nozzles 96*b* to 96*g*, with the feeding direction A2 in a plan view is 9 to 45 degrees, or preferably selected around 30 degrees. Further outwardly of the nozzles 96*a*, 96*h* in the widthwise direction are arranged nozzles 96*i* and 96*j* respectively in parallel to the nozzles 96*a* and 96*h*.

On the other hand, the angle $\beta$ of the nozzles 96*a*, 96*h* formed with the feeding direction A2 in the side view shown in FIG. 4, that is, with the central laying part 48 is 3 to 10 degrees, or preferably selected around 3.5 degrees, and is determined as follows. First of all, by the entire structure of the copying machine 22 including the paper feeder 21, the configuration of the nozzle member 93 is determined, and therefore the base end positions of the nozzles 96*a* to 96*h* determined. On the other hand, as shown in FIG. 4, the air flow C in the side view of each nozzle 96 is above the feeding stretch belt 98, and is injected to a position remote from the suction region 108 set on the feeding stretch belt 98 by the vacuum attracting box 104 by a predetermined distance L1 to the downstream side of the feeding direction A2.

Figure 25:
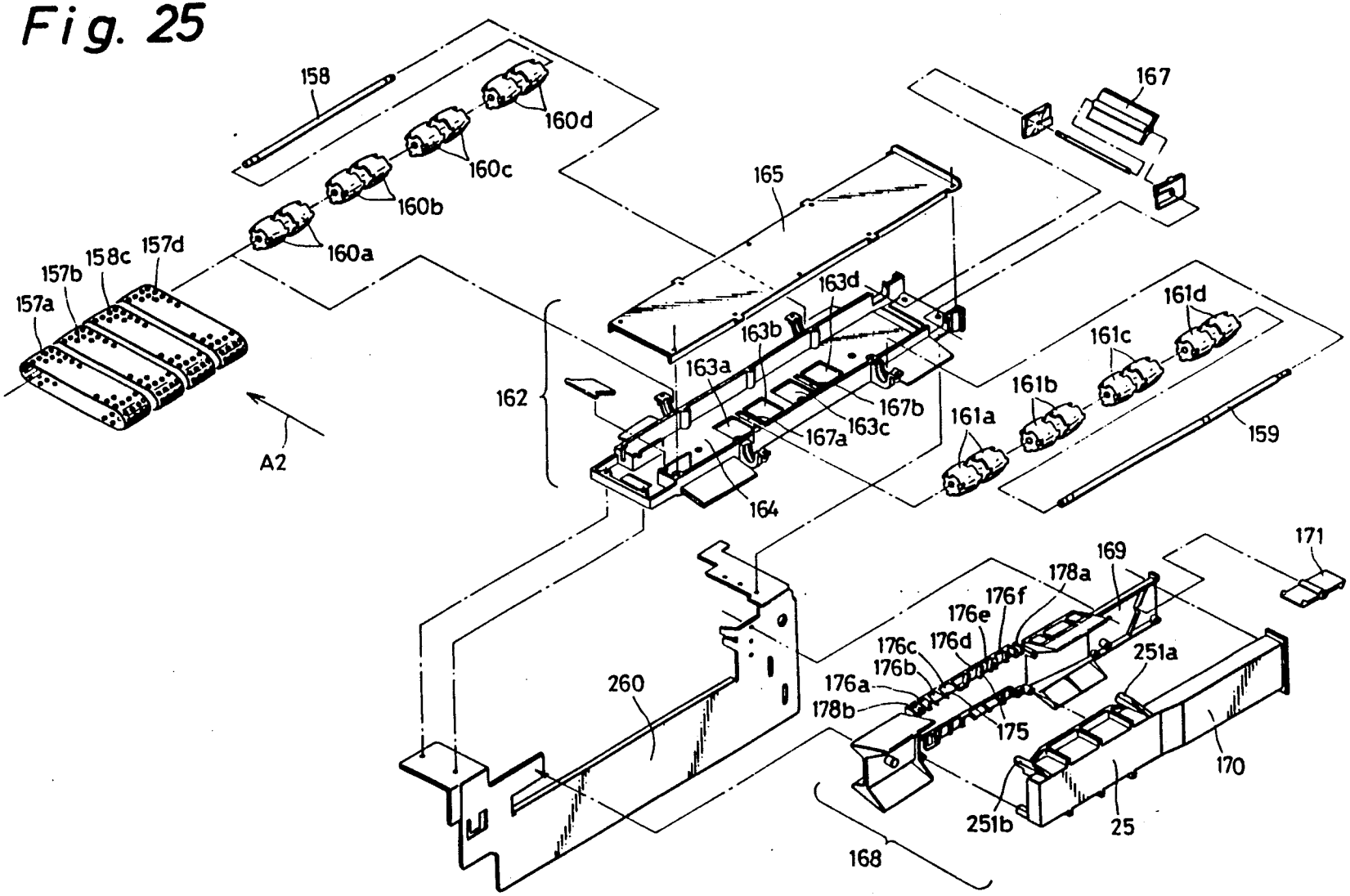
FIG. 25 is an exploded perspective view of the configuration illustrated in FIG. 24.

In this embodiment, in other words, the air flow C is not directly blown to the downstream side end part of the feeding direction A2 of the recording papers P stacked up as shown in FIG. 25 on the laying plate 45 including the range above the feeding stretch belt 98, but it is once injected to the feeding stretch belt 98 at the downstream side of the feeding direction than the downstream side end portion of the feeding direction of the stacked-up recording papers, and the reflected air flow collides against the downstream side end part in the feeding direction A2 of the recording papers P, thereby separating the bottom recording paper P1 from the second recording paper P2. That is, if the air flow C is directly injected to the downstream side end part of the recording paper, such air flow generates a force for pressing the recording papers P to the downward side, which may be inconvenient for separating the recording papers. By using the reflected flow, the recording paper P is blown upward, apart from the feeding stretch belt 98, so that the separation action may be done smoothly. Besides, the air flow from the nozzle 96 does not contribute to the separation of recording papers, which is effective to prevent undesired attracting to the vacuum attracting box 104.

The configuration of the nozzles 96*b*, 96*g* is selected so that the distance L1 of the nozzles 96*b*, 96*g* may be shorter than the length L2 of the longer side of the recording paper of the minimum width assumed to be used, for example, the B5 format of JIS, and the air flow C11 composed of the injection flow C1 from the nozzles 96*b*, 96*g*, and the injection flow C2 from the nozzles 96*c*, 96*f* is directed inward in the widthwise direction than the both end parts of the widthwise direction of the recording paper of the minimum width. Besides, the configuration of the nozzles 96*a* and 96*h*; 96*i* and 96*j* is determined so that their distance L3 may be shorter by a specific extent than the length of the longer side of the maximum recording paper assumed to be used, for example, B4 or A3 of JIS or the double letter size WLT generally used in English-speaking nations (11 inches by 17 inches), and the air flow C5 from these nozzles 96*i* and 96*j* is directed inward in the widthwise direction than the both end parts of the widthwise direction of the maximum recording paper.

Beneath the feeding stretch belt 98, the side plate 56 is fixed, and a longitudinal support plate 109 is disposed in the widthwise direction. In the central position of the support plate 109 in the widthwise direction, a pivot 110 is set up, and relating to the pivot 110, guide grooves 111 and 112 extending in the widthwise direction are formed at both sides in the widthwise direction. Guide pins 113 to 116 are set up on the support plate 109, and these guide pins 113 to 116 are inserted into slots 119, 120; 121, 122 formed on the support plate 109 and extending in the widthwise direction of longitudinal driving members 117 and 118 in the widthwise direction, and the driving members 117 and 118 are defined in the moving direction in the widthwise direction by the guide pins 113 to 116.

In the mutually confronting edge parts of the driving members 117, 118, racks, 123, 124 are formed respectively, and are engaged with a gear 125 rotatably installed in the pivot 110 mutually from the opposite sides. On this gear 125, a bevel gear 126 is coaxially fixed, and it is engaged with a bevel gear 129 fixed at the front end of a rotary shaft 128 rotated by a pulse motor 127 fixed on the side plate. At the outer end parts in the widthwise direction of the driving members 117, 118, there are fixed lateral end defining plates 130 and 131 engaged with the slots 54*a*, 55*a*; 54*b*, 55*b* of the laying plate 45, and arranged being projected upward from the laying plate 45.

That is, in the copying machine 22, when any of the paper feeders 38 to 40 in which recording papers of various sizes are stored is selected, the pulse motor 127 is driven in a specified direction by the action of the control unit mentioned later, and the amount of rotation depends on the engagement of the bevel gears 129, 126, and the driving members 117, 118 are displaced inward or outward along the widthwise direction, and the gap of the lateral end defining plates 130, 131 is set to the size of the selected recording paper, thereby aligning the lateral ends in the widthwise direction of the recording papers delivered onto the laying plate 45.

Figure 10:
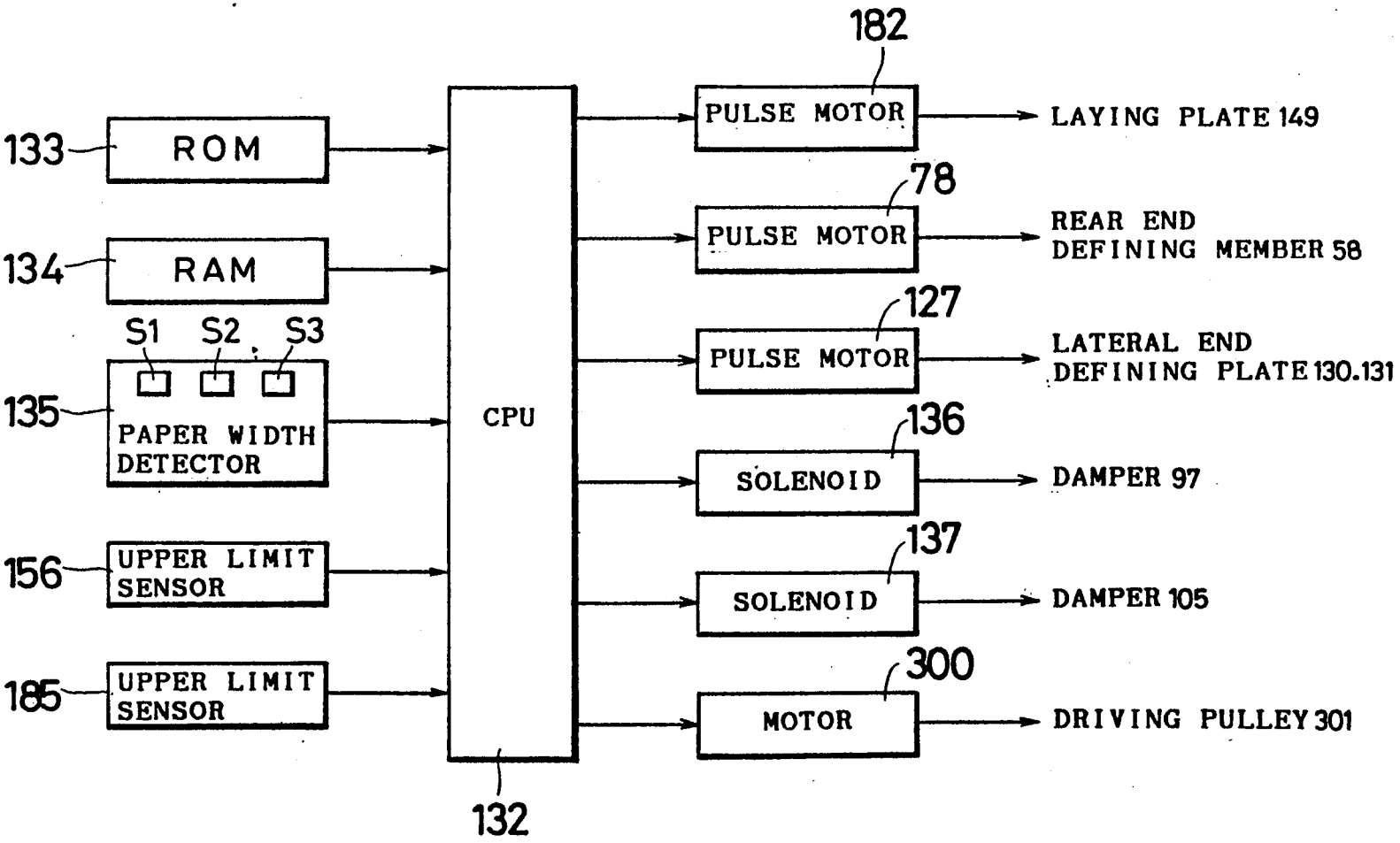
FIG. 10 is a block diagram showing an electric composition of the copying machine 22.

FIG. 10 is a block diagram showing an electric composition of the copying machine 22, which is a basic configuration of this invention, in which only essential parts are shown for the sake of simplicity of explanation. The copying machine 22 comprises, for example, a central processing unit (CPU) 132 containing a microprocessor, and the CPU 132 controls the actions of the copying machine 22, for example, according to the action program stored in a ROM (read-only memory) 133. The CPU 132 comprises a RAM (random access memory) 132 for storing the input data such as number of copies and various operation modes, and a paper width detector 135 for detecting the width of the recording papers stored in the paper feeders 38 to 40.

A constitutional example of the paper width detector 135 is shown later in FIG. 26, and anyway in the paper feeding apparatus 21, the lateral end defining plate 131 is manually operated, and limit switches or other position sensors are disposed for every moving position of the lateral end defining plate 131, corresponding to JIS sizes such as B4, B5 and A4, or American or European sizes such as letter size LT (11 inches by 8.5 inches), regal size RG (14 inches by 8.5 inches) and double letter size WLT (17 inches by 11 inches).

The pulse motors 78 and 127 are connected to the CPU 132, and on the basis of the dimension in the widthwise direction of the recording paper being used detected by the paper width detector 135, the rear end defining member 58 is moved to the upstream side or downstream side of the feeding direction A2, and the lateral end defining plates 130 and 131 are moved inward or outward in the widthwise direction. Moreover, electromagnetic solenoids 136 and 137 are connected to open or close the dampers 97 and 105. Furthermore, the CPU 132 controls the pulse motor 132 which moves up and down the laying plate 45 of the recording papers of the paper feeders 38 to 40 within the paper feeders 38 to 40.

Figure 11:
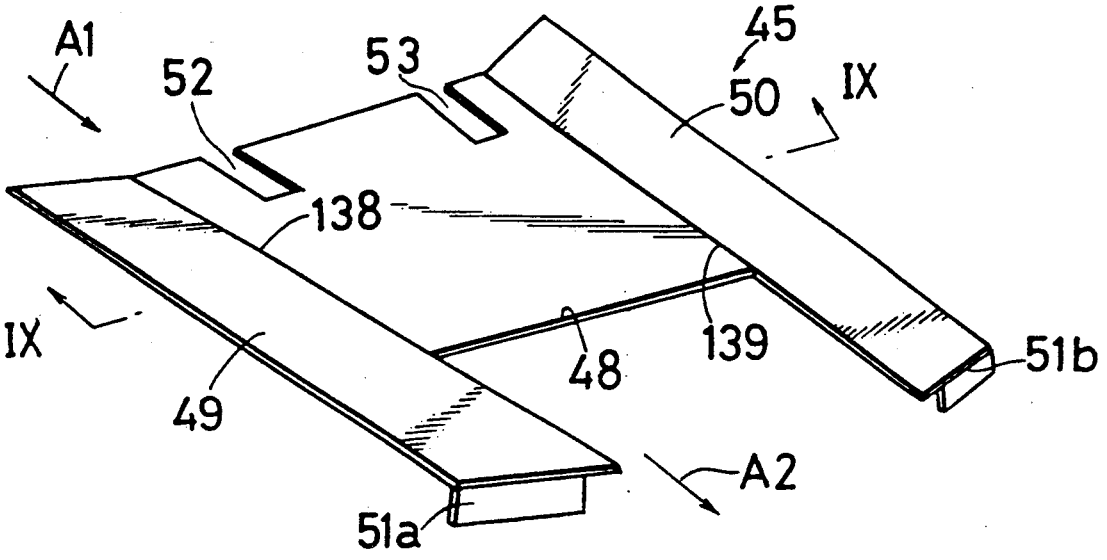
FIG. 11 is a perspective view of a laying plate 45.
Figure 12:
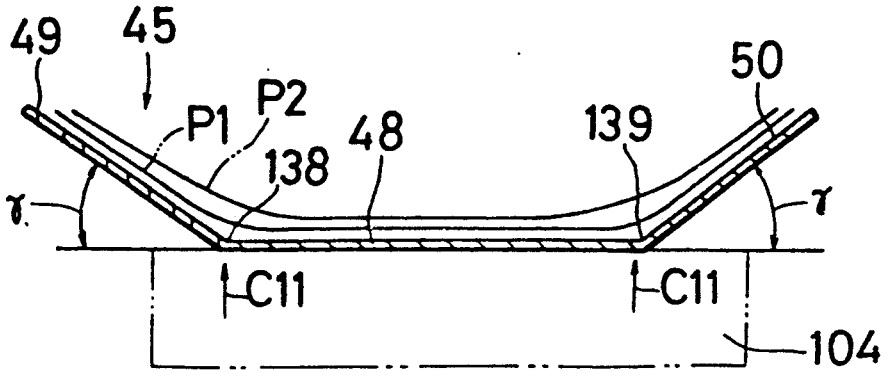
FIG. 12 is a cross sectional view of the laying plate 45.

FIG. 11 is a simplified magnified perspective view of the laying plate 45, FIG. 12 is a sectional view from sectional line X13—X13 of FIG. 11, and FIGS. 13 to 15 are view illustrating a separating operation by air flows in this explanatory configuration. Regarding the central laying part 48 of the laying plate 45, the both side laying parts 49 and 50 are bent upward by the angle $\gamma$ (3 to 10 degrees, preferably about 3.5 degrees) as predetermined as going outward in the widthwise direction, and bent parts 138 and 139 are formed in their boundary, parallel to the feeding direction A2. In the feeding apparatus 21 of the configuration in order to separate the bottom recording paper P2 and the second recording paper P2 in the stacked recording papers P, it is necessary that the gap in which the air flow from the nozzle 96 is blown and injected be formed between the recording papers P1 and P2. Accordingly, in this configuration, the angle $\gamma$ is set between the central laying part 48 of the laying plate 45 and the lateral laying parts 49, 50, and the bent parts 138, 139 are composed. Moreover, the step difference height $\delta$ is provided between the inward end part i the widthwise direction of the lateral laying parts 40, 50 and the feed stretch belt 98.

Figure 13:
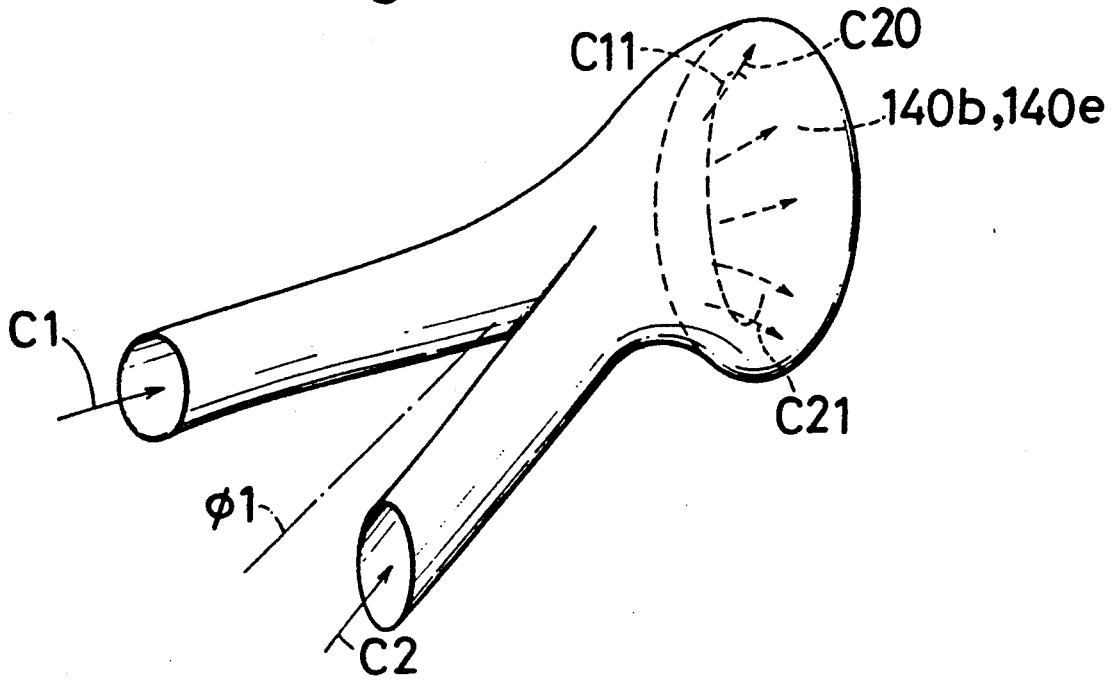
FIG. 13 is a perspective view illustrating states of air flows jetted from nozzles **96*b*, 96*c* in the paper feeder 21**.
Figure 14:
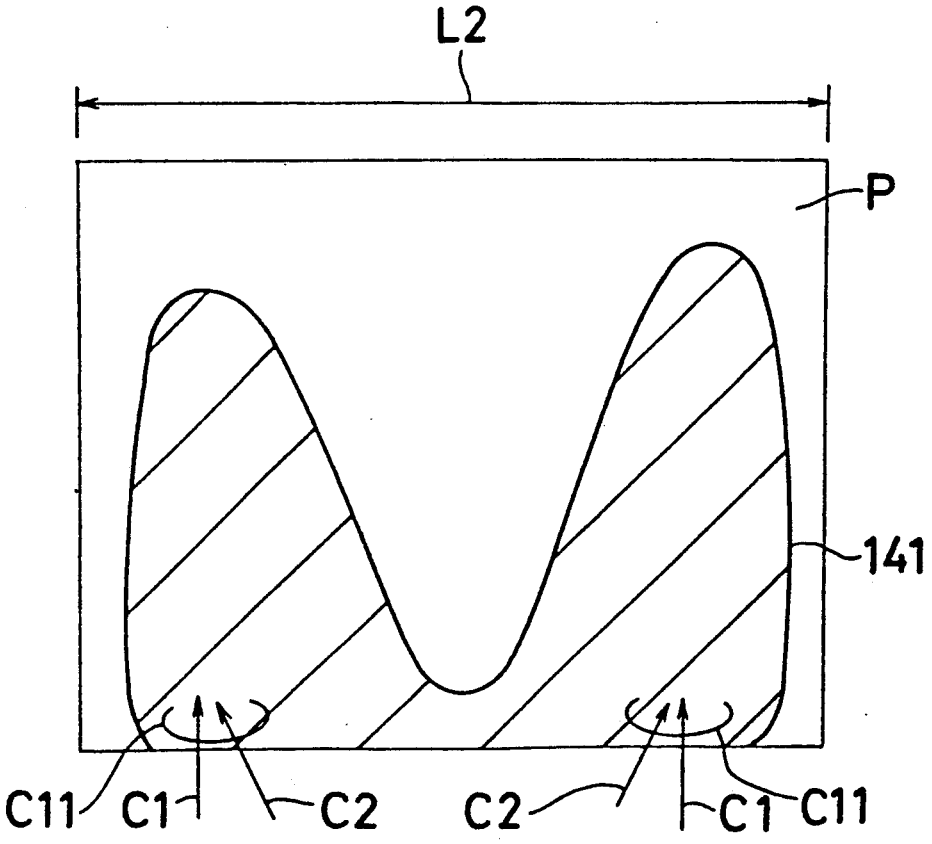
FIG. 14 is a plan view illustrating states of air flows jetted from nozzles **96*b*, 96*c*; 96*f*, 96*g* of the paper feeder 21**.
Figure 15:
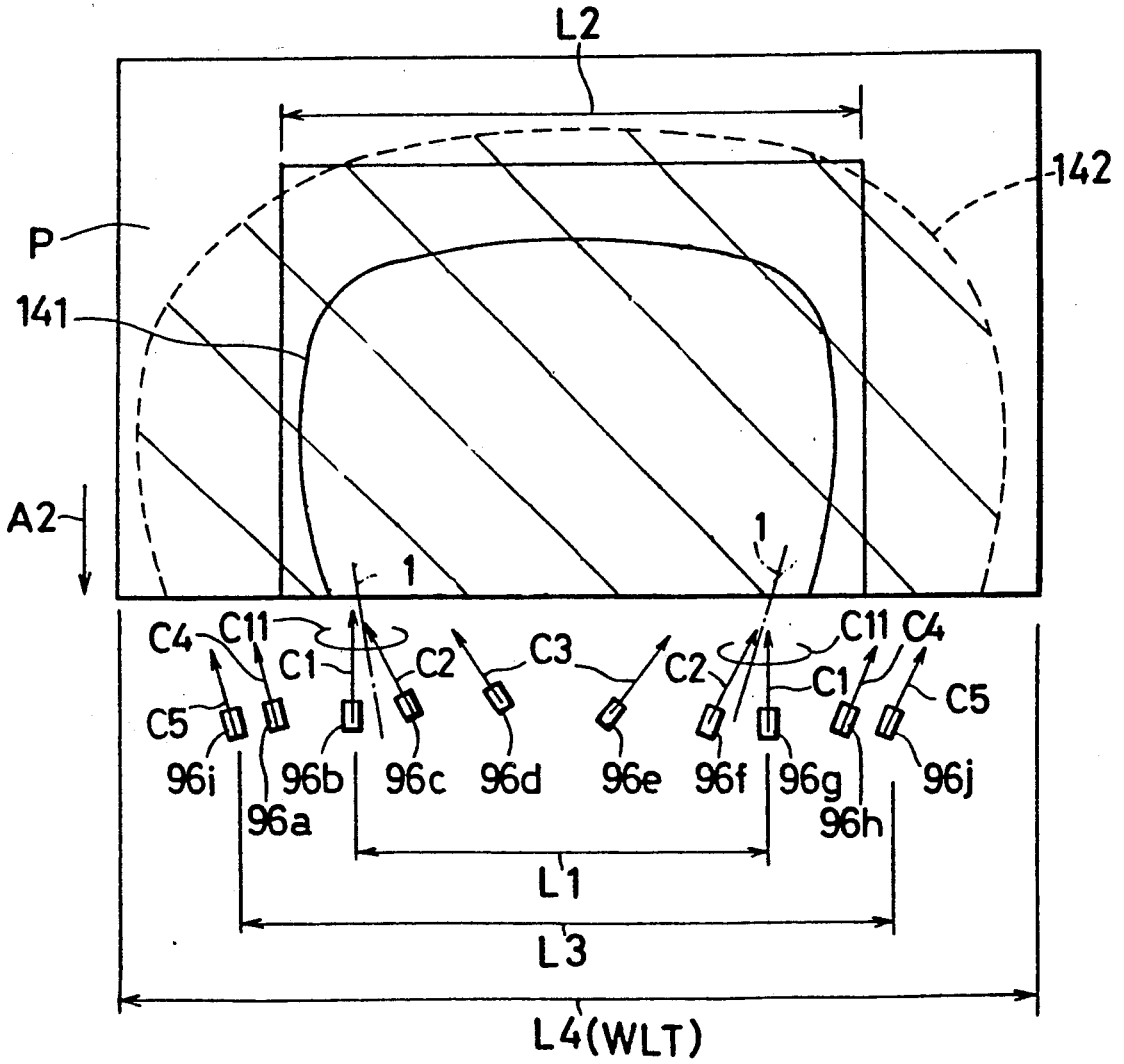
FIGS. 15A–C are top plan views illustrating states of air flows jetted from nozzles **96*a* to 96*j***.
Figure 15B:
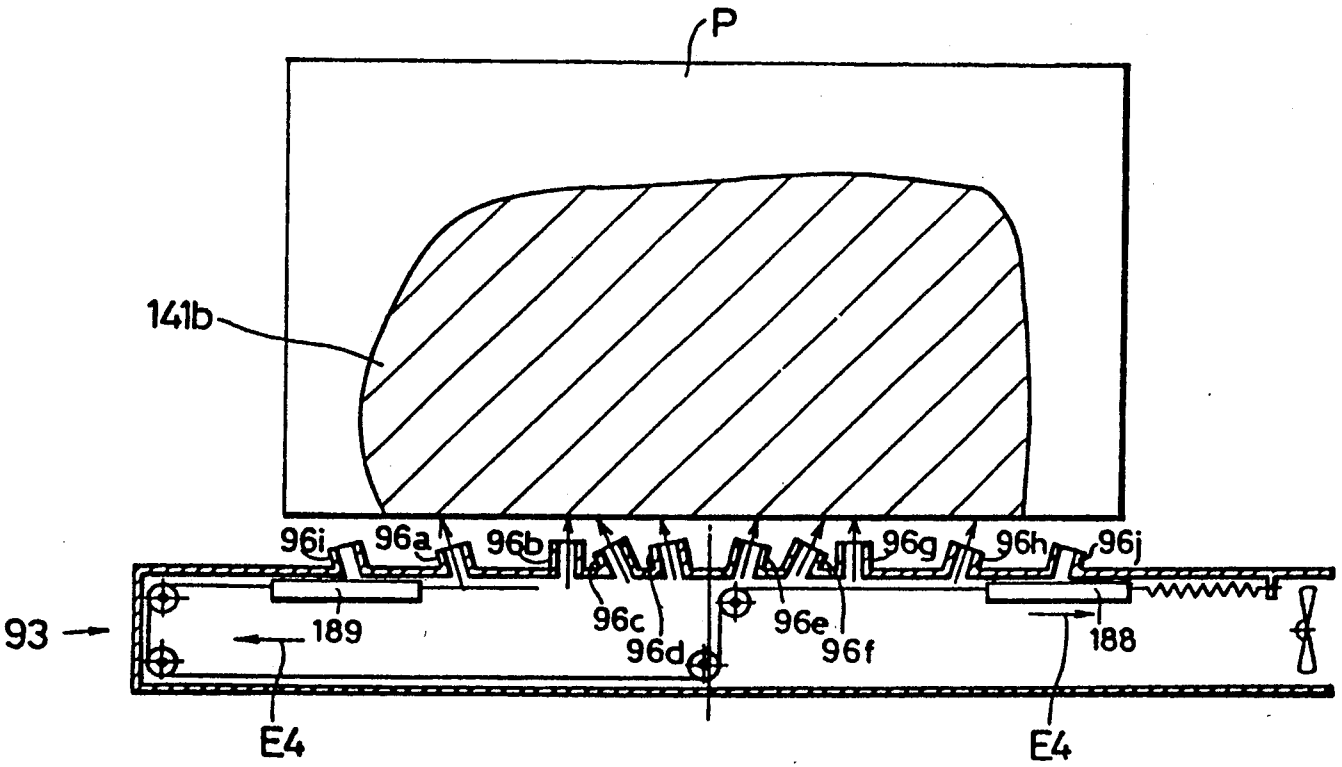
Figure 15C:
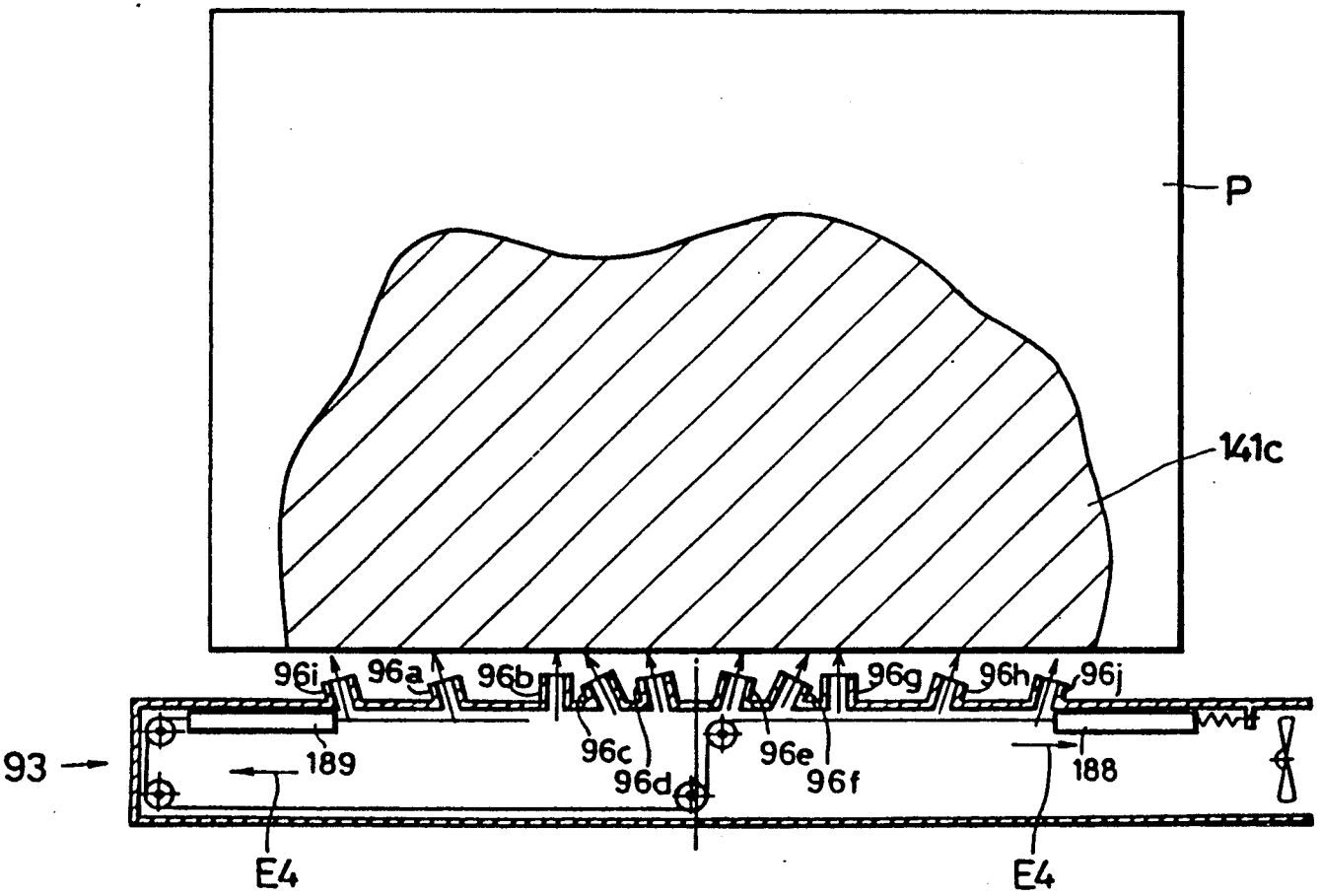
Figure 16:
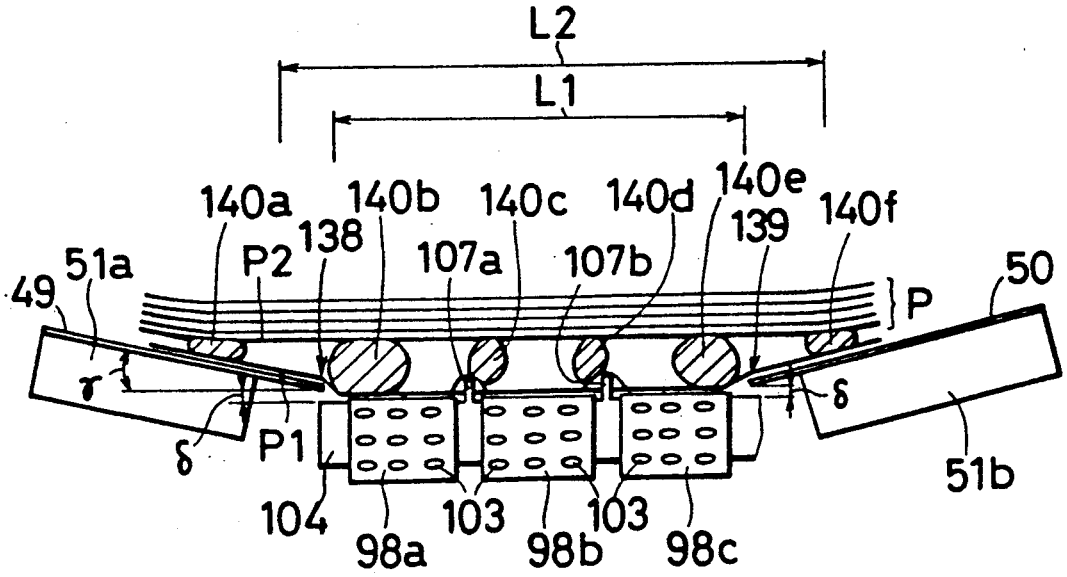
FIG. 16 is a side view illustrating a basic operation of the paper feeder 21.

Therefore, when the recording paper P1 is attracted as shown in FIG. 12 by the negative pressure by the vacuum attracting box 104 to the feeding stretch belts 98*a* to 98*c*, a gap is formed between the recording papers P1 and P2, at least near the bent parts 138 and 139. The nozzles 96*b*, 96*c*; 96*f*, 96*g* are composed so as to blow the air flow C11 into the gap around the bent parts 138, 139 along the center line 11 as shown in FIGS. 13, 14, 15A, and therefore the blown air flow C11 is inflated in the vertical direction. The vacuum attracting box 104 has protrusions 107*a*, 107*b*, and the recording paper P1 is curved in a profile along these protrusions 107*a* and 107*b* as shown in FIG. 16. On the other hand, since the second recording paper P2 is not attracted by the vacuum attracting box 104, a gap is produced against the recording paper P1 at both sides of the protrusions 107*a* and 107*b*.

The nozzles 96*d* and 96*e* blow air flow into the gap at the inward side in the widthwise direction of the protrusions 107*a*, 107*b*, and this air flow collides against the side walls of the protrusions 107*a*, 107*b* to inflate in the vertical direction. As a result, regions 140*c*, 140*d* shown in FIG. 16 are created, which contributes to separation of the recording papers P1 and P2. At this time, as mentioned above, the layout gap L1 between the nozzles 96*b*, 96*g* is set shorter than the length L2 of the longer side of the recording paper in, for example, B5 format of JIS. Still more, the injection flows indicated by arrows C2, C3 directed from inward to outward in the widthwise direction of the nozzles 96*c* to 96*f* are blocked by the injection flows parallel to the feeding direction A2 as indicated by arrow C1 of the nozzles 96*b*, 96*g* to be united into one air flow C11, which runs in the direction of arrow C11 and is inflated in the vertical direction as mentioned above, thereby realizing the separating region 141 shown in FIG. 15A. It is therefore possible to avoid flapping of the widthwise end parts, or disturbance of stacked state or emission of noise, due to ejection of the air flow C11 from the widthwise ends of the recording paper with width L2.

FIG. 16 is a front view for proving the separation action of recording papers in this configuration. The shaded regions 140*a* to 140*f* in FIG. 16 indicate the size and range of the air flow for separating the bottom recording paper P1 in the stack of recording papers P from the second recording paper P2 and others, by the injection of the air flow by the nozzles 96*a* to 96*h* mentioned above. In the regions 140*b*, 140*e*, the jet flows are concentrated in the widthwise direction as indicated by arrows C1, C2 by the nozzles 96*b*, 96*c*; 96*f*, 96*g*. Therefore, the jet flows concentrated along the widthwise direction as shown in FIG. 5 inflate vertically as shown by arrows C20, C21, and the recording papers P1, P2 are separated by this pressure. The occupied areas of the air flows inflating in the vertical direction are indicated as regions 140*b* and 140*e* in FIG. 16.

As examples of recording paper with wider width L4 than the width L2, there are double letter size and B4 size recording papers, and when separating such wide recording papers, the gap L3 of the nozzles 96*a* to 96*i* is selected smaller than the width L4 as mentioned above. Moreover, the laying plate 45 has step different parts 51*a*, 51*b* in the running direction of air flow from the nozzles 96*a*, 96*h*; 96*i*, 96*j* as stated above. That is, the majority of the air flow from the nozzles 96*a*, 96*h*; 96*i*, 96*j* collides against the step parts 51*a*, 51*b*, and flows in other direction than the laying plate 45, so that the flow rate and speed may be suppressed.

Therefore, the air flow from the nozzles 96*a*, 96*h*; 96*i*, 96*j* indicated by arrow C4, C5 is relatively weakened, and injected between the recording papers p1, P2. In consequence, the separating region 142 in the recording paper P with width L4 becomes a region enclosed with broken lines in FIG. 15A, and a wider area is realized than in the case of the separating region 141 for the recording paper P of smaller size. In this embodiment, more specifically, even if the recording papers are greater in width or size, it is possible to separate effectively. Still more, near the both ends in the widthwise direction of larger recording paper P, as mentioned above, the air flow from the nozzles 96*a* to 96*j* is controlled in flow rate to be injected. Therefore, it is possible to avoid disturbance of stacked state or generation of noise due to flapping of the end parts of the recording papers as mentioned above, resulting from the leak of air flow from both sides in the widthwise direction of the larger recording papers P.

According to the configuration, a relatively large separating capacity is realized by concentrating the air flows in the regions 140*b*, 140*e* shown in FIG. 16, and the separating capacity is further enhanced by injecting the air flow at specified flow rate into the regions 140*a*, 140*c*, 140*d*, 140*f*. Therefore, the configuration of the nozzles 96*a* to 96*j* for realizing the characteristic action is not limited to the layout shown in FIGS. 5 and 6.

Figure 17:
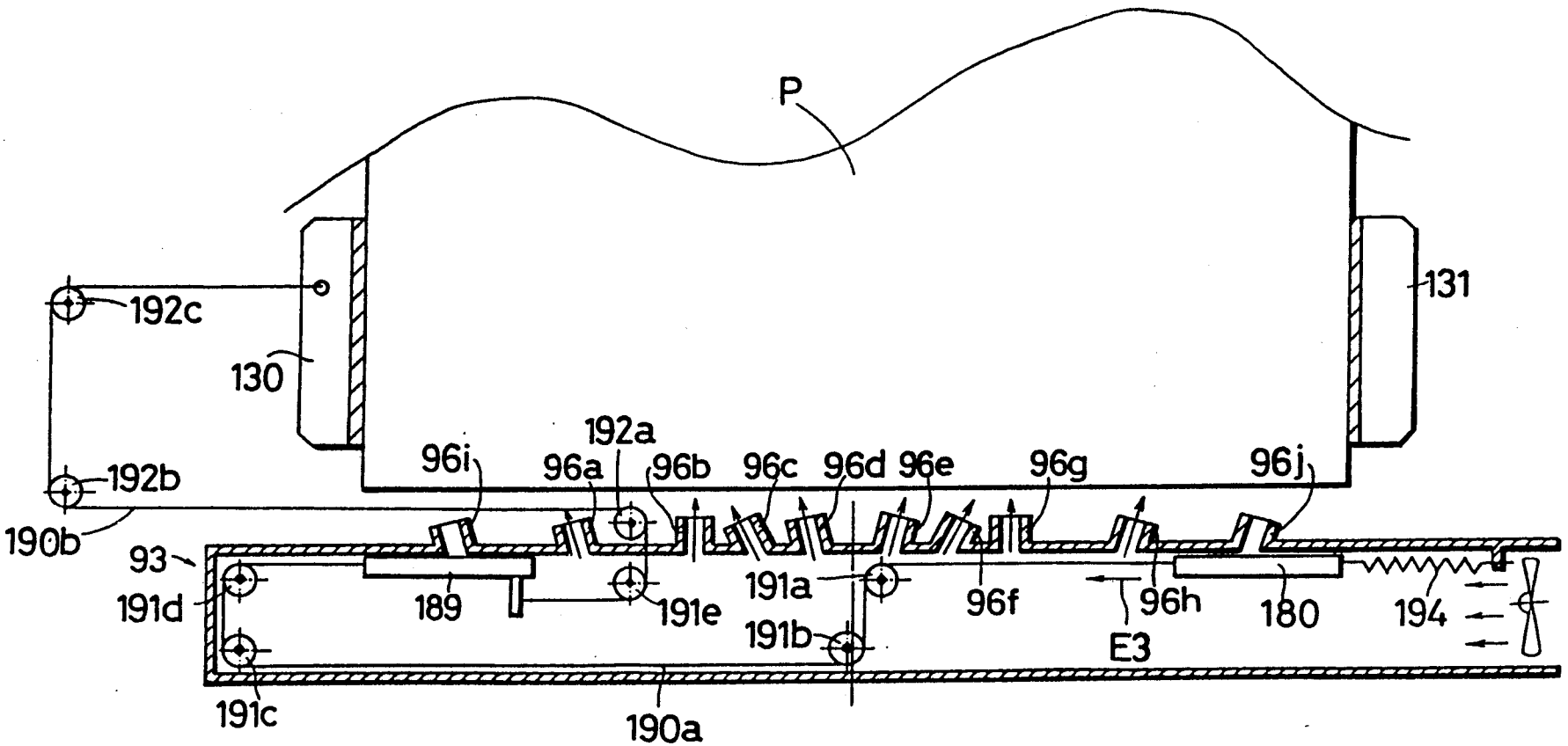
FIG. 17 is a cross sectional view illustrating an explanatory configuration of the paper feeder 21 of a first embodiment of the invention.

FIG. 17 is a cross sectional view illustrating an internal configuration of the nozzle member 93 in the paper feeder 21 of the first embodiment of the invention. In the nozzle member 93 are arranged nozzles 96*a* to 96*j* in an aforementioned manner which respectively formed jet flows C1, C2, C3, C4, and C5. In the nozzle member 93 is normally disposed a valve 188 outwardly of the nozzle 96*h* in the widthwise direction covering the base end of the nozzle 96*j*. The valve 188 is formed to have a length sufficient to cover the base ends of the nozzles 96*h*, 96*i* at the same time. Also, a valve 189 is normally disposed inwardly of the nozzle 96*a* in the widthwise direction covering the base end of the nozzle 96*i*. The valve 189 is formed to have a length sufficient to cover the base ends of the nozzles 96*a*, 96*i* at the same time.

The valves 188, 189 are disposed reciprocatingly movable in the widthwise direction and coupled to each other by a wire 190*a*. In the nozzle member 93, one end of the wire 190*a* is connected to the inner side of the valve 188 and the other end thereof is extended up to the periphery of the valve 189 through pulleys 191*a*, 191*b* arranged along the feeding direction, and connected to the outer side of the valve 189 through pulleys 191*c*, 191*d* arranged along the feeding direction near the valve 189.

On the other hand, to the inner side of the valve 189, i.e., to the side of the valve 189 opposing to the valve 188, is connected one end of a wire 190*b*. The other end of the wire 190*b* is pulled outwardly of the nozzle member 93 through a pulley 191*e* arranged therein and extended up to the periphery of the lateral end defining plate 130 illustrated in FIG. 5 through pulleys 191*e* and 192*a* arranged along the feeding direction. The wire 190*b* is connected to the lateral end defining plate 130 through pulleys 192*b*, 192*c* arranged along the feeding direction.

Further, the valve 188 has a spring 194 connected thereto and is biased to the side opposite the valve 189. The wires 190*a*, 190*b*, pulleys 191*a* to 191*e*, 192*a* to 192*c*, and lateral end defining plate 130 constitute the driving means.

The type of the recording paper to be fed to the paper feeder 21 is determined by selecting any one of the paper feeders 38 to 40 in the foregoing embodiment. More specifically, in the selected paper feeder 38, for example, is provided a paper width detecting mechanism to be described below, and the CPU 132 shown in FIG. 10 can detect the width of the set recording paper in accordance with the displaced positions of manually set lateral end defining plate 195, 196 to be illustrated in FIG. 26.

In the case where the selected recording paper P is relatively small-sized and the air flows C4, C5 from the nozzles 96*a*, 96*h*; 96*i*, 96*j* are formed, the air flows C4, C5 leak outwardly from the lateral end portions of the recording paper P in the widthwise direction. As a result, the lateral ends of the recording paper P are liable to flap. In this case, the stacking state of the recording papers P in the paper feeder 21 is disordered and thereby the recording papers P are subject to duplicate feed and feeding failure. In addition, noise is likely to be generated.

Figure 18:
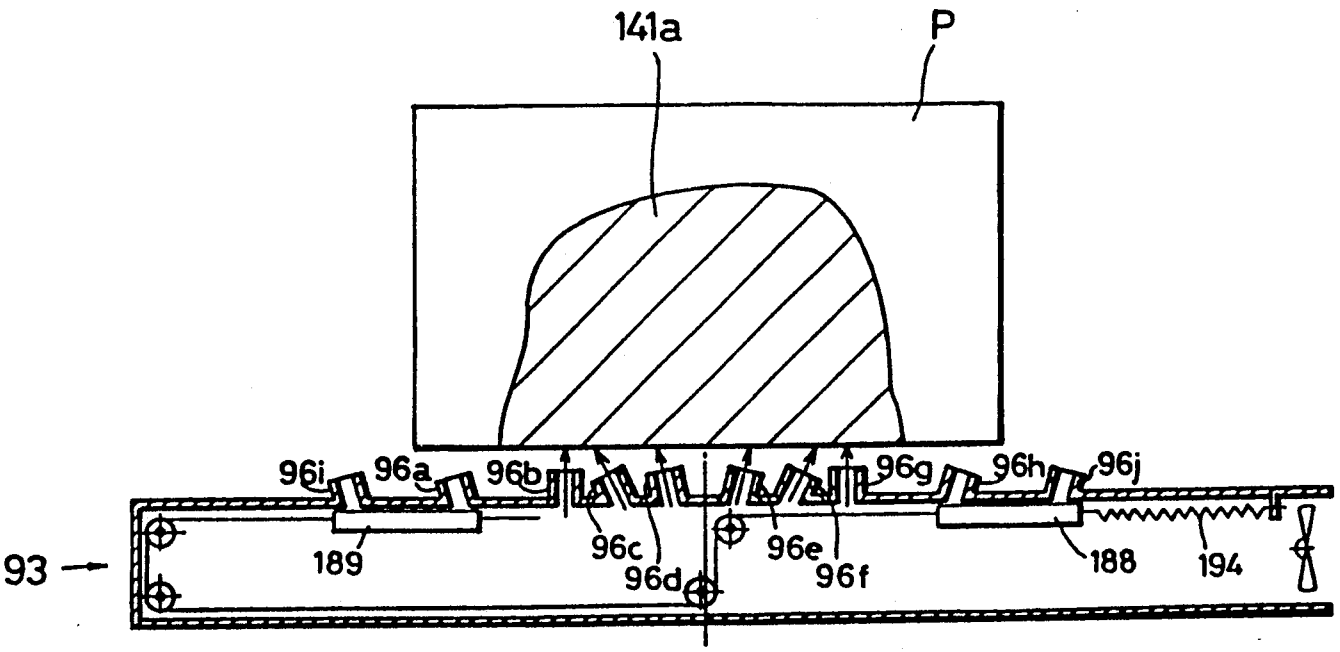
FIG. 18 is a cross sectional view illustrating the operation of the first embodiment.

FIG. 18 is a cross sectional view illustrating an operation of the valves 188, 189 of the first embodiment correspondingly to the recording papers P of plural sizes. In the first embodiment, in order to avoid the aforementioned occurrences, in the case where the recording papers P are relatively small-sized, the pulse motor 127 is actuated by the control of the CPU 132 to move the valves 188, 189 in an arrow direction B3 respectively to close the hose end portions of the nozzles 96*h*, 96*i*; 96*a*, 96*i*. Accordingly, the air flows C4, C5 are not formed, and only the air flows C1 to C3 are formed. Thus, a separation region 141*a*, an oblique-lined portion in FIG. 18, can be obtained in the stacked up recording papers P and thereby satisfactory separation of the small-sized sheets can be effected.

On the other hand, in the case where the selected recording paper P is relatively medium-sized and the air flow C4 is not to be formed, only a small-scale separating region 141*a*, an oblique-lined portion in FIG. 18, formed by the air flows from the nozzles 96*b* to 96*g* is formed and therefore separating failure, duplicate feed or the like are likely to occur in feeding the medium-sized recording paper P. Accordingly, in this embodiment, in the case where the selected recording paper P is relatively medium-sized, the pulse motor 127 is actuated by the CPU 132 so as to move the valves 188, 189 in an arrow direction E4 respectively to close the base end portions of the nozzles 96*i*, 96*j* in FIG. 18. Consequently, the air flow C5 is not formed but only the air flows C1 to C4 are formed.

In this manner, a separating region 141*b* slightly larger than the separating region 141 can be formed, so that separation of the medium-sized recording paper P can be satisfactorily effected.

Moreover, in the case where the selected recording paper P is relatively large-sized and the air flows C4, C5 are not to be formed, only a separating region 141*b*, an oblique-lined portion in FIG. 18, formed by the air flows from the nozzles 96*a* to 96*h* is formed and therefore separating failure, duplicate feed or the like are likely to occur in feeding the large-sized recording paper P. Accordingly, in the case where the selected recording paper P is relatively large-sized, the pulse motor 127 is actuated by the CPU132 so as to move the valves 188, 189 in the arrow direction E4 laterally and outwardly in FIG. 18. Consequently, the air flow C1 to C5 are formed.

In this manner, all the nozzles are opened to form the air flows C1 to C5 and thereby a separating region 141*c* considerably larger than the separating regions 141*a*, 141*b* is formed, so that separation of the large-sized recording paper P can be satisfactorily effected.

Figure 19:
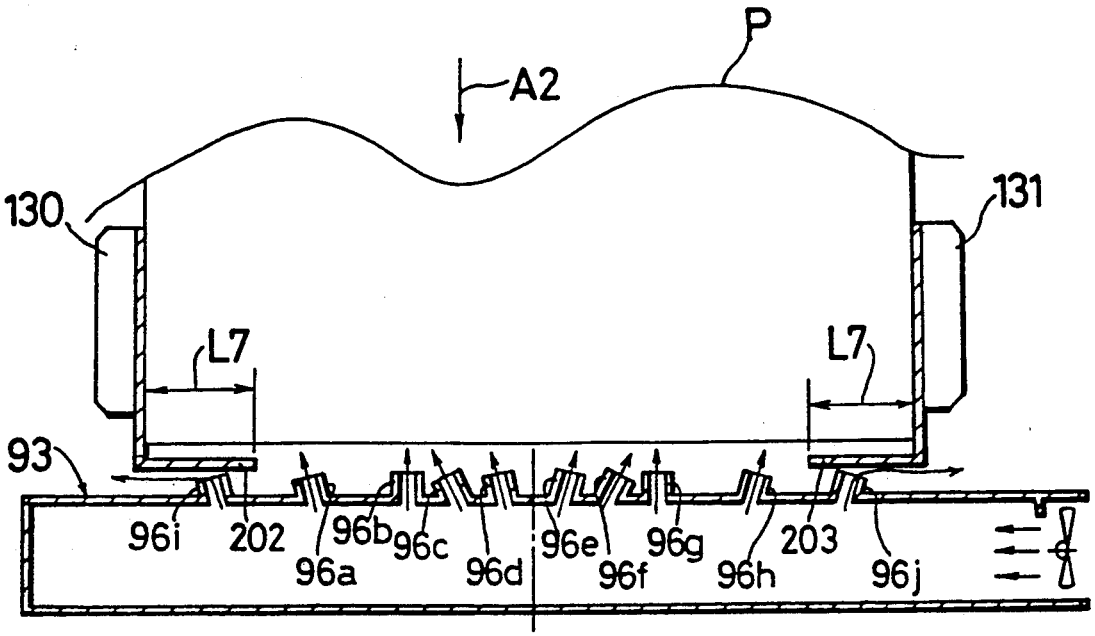
FIG. 19 is a top plan view illustrating an explanatory configuration of a second embodiment of the invention.
Figure 20:
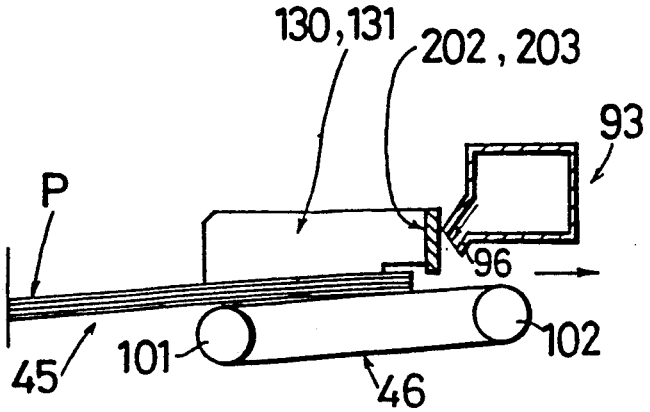
FIG. 20 is a cross sectional view of the configuration illustrated in FIG. 19.

FIG. 19 is a plan view illustrating a cross section of a configuration in the periphery of the nozzle member 93 of a second embodiment of the invention and FIG. 20 is a cross sectional view of the configuration illustrated in FIG. 19. The second embodiment is similar to the first embodiment and like reference numerals designate like or corresponding parts throughout. In the second embodiment, at downstream portions of the lateral end defining plates 130, 131 with respect to the feeding direction A2 are respectively formed shut-off pieces 202, 203 extending inwardly in the widthwise direction. When the lateral end defining plates 130, 131 are positioned with spaced to each other by a distance corresponding to the width of the small-sized recording paper, the shut-off pieces 202, 203 respectively shut off the nozzles 96*i*, 96*j* of the nozzle member 93. As a result, the air flow C5 directed at the recording paper P is shut off.

On the other hand, in the case where lateral end defining plates 130, 131 are positioned with spaced to each other by a distance corresponding to the width of the large-sized recording paper P, the shut-off pieces 202, 203 do not shut off the nozzles 96*i*, 96*j*. Thus, all the nozzles are opened to jet the air flows. Further, a widthwise length L7 of the shut-off pieces 202, 203 is determined so that the shut-off pieces 202, 203 respectively shut off and open the nozzles 96*i*, 96*j* according to a change in the distance between the set lateral end defining plates 130, 131.

In the embodiments such as the one described above, the nozzles 96*i*, 96*j* are made openable and closable in accordance with the size of the recording paper P and similar effects to the ones demonstrated by the foregoing embodiment can be achieved.

Figure 21:
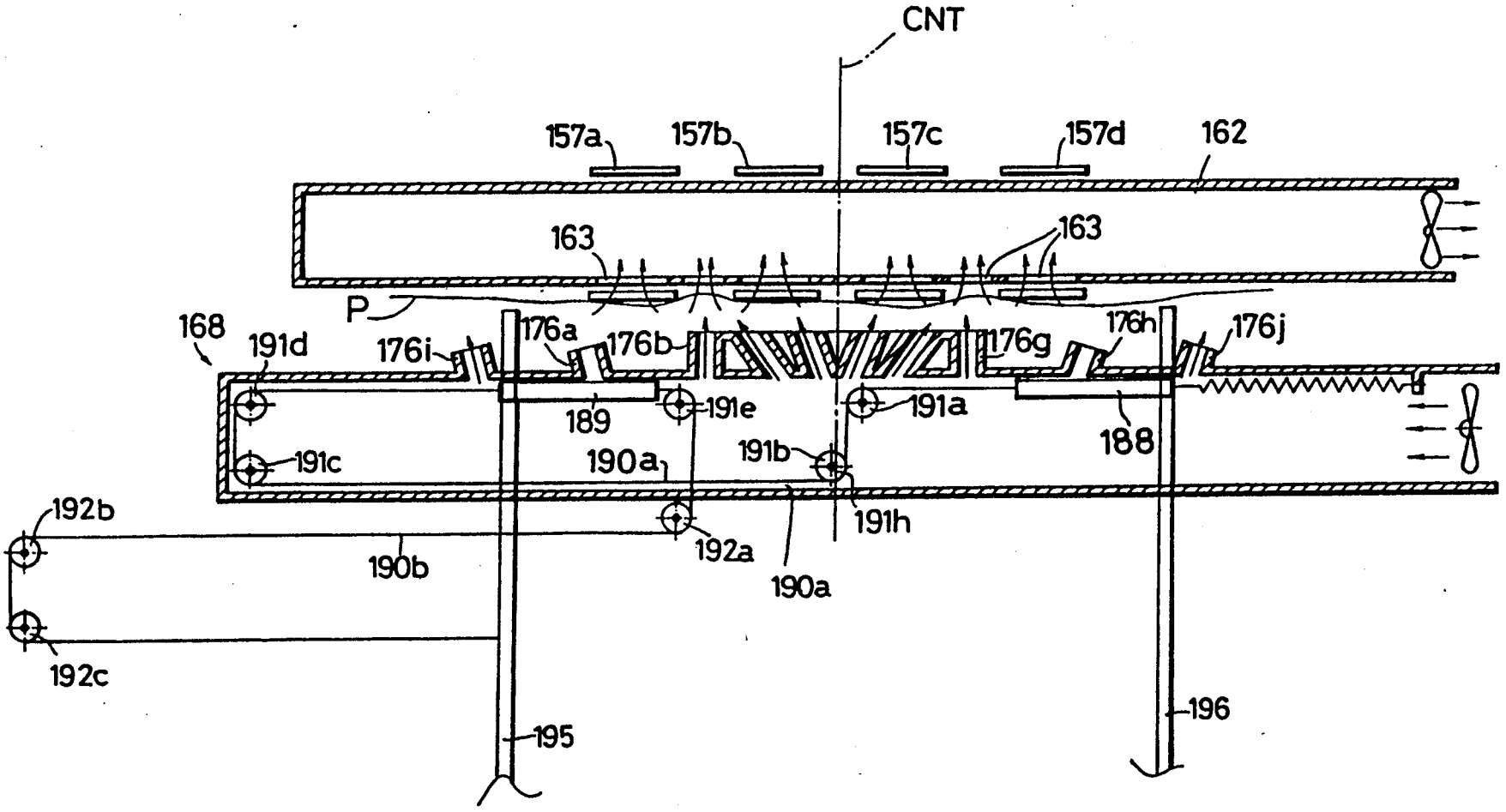
FIG. 21 is a cross sectional view illustrating another explanatory configuration of a nozzle member 93 of a third embodiment of the invention.
Figure 22:
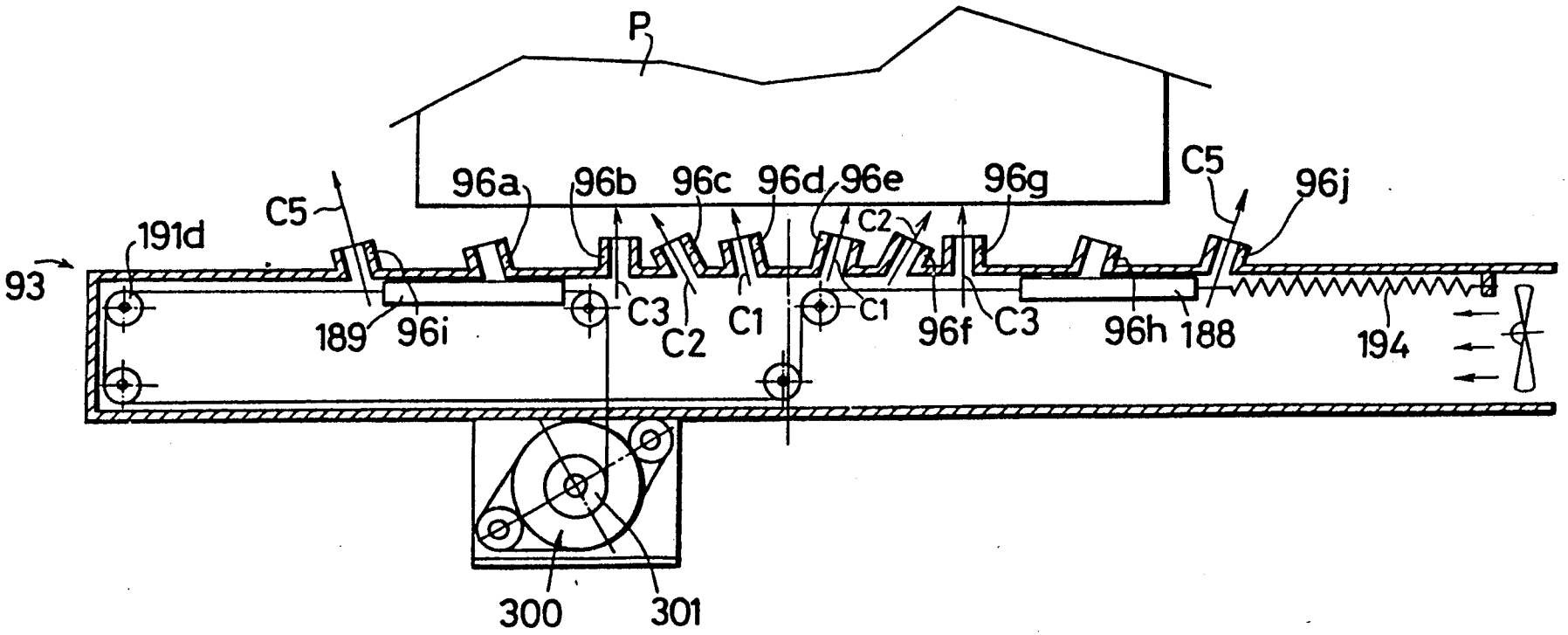
FIG. 22 is a cross sectional view illustrating an operation of the third embodiment.

FIG. 21 is a cross sectional view illustrating an explanatory configuration of the nozzle member 93 in the paper feeder 21 of a third embodiment of the invention and FIG. 22 is a cross sectional view illustrating an explanatory operation of the nozzle 93. The third embodiment is similar to the foregoing embodiment and like reference characters designate like or corresponding parts. In the third embodiment as well, the valves 188, 189 are arranged in the nozzle member 93 in an identical manner as the foregoing embodiments. The wire 190*a* is connected to each of the valves 188, 189 and the wire 190*b* connected to the valve 189 is pulled out of the nozzle member 93 through the pulley 191*e* and rolled on a driven pulley 301 drivingly rotated by a motor 300.

The motor 300 is controlled by the CPU 132 illustrated in FIG. 10 correspondingly to the size of the recording paper P set prior to execution of the copying operation, so that the motor 300 is driven appropriately to rotate in both directions. Accordingly, similar effects to the ones explained with reference to the foregoing embodiments can be achieved. More specifically, in the case where relatively large-sized recording papers P are to be fed, the valves 188, 189 are caused to close the nozzles 96*i*, 96*j* as illustrated in FIG. 21. However, the nozzles 96*a*, 96*h* are open, so that the air flows C1 to C4 are formed. On the other hand, in the case where the relatively small-sized recording papers P are to be fed, the valves 188, 189 are caused to close the nozzles 96*a*, 96*h*. In this case, the nozzles 96*i*, 96*j* are opened. However, the air flow C5 and opposite lateral ends of the recording paper P in the widthwise direction are sufficiently spaced to each other. Accordingly, the likelihood that the recording papers P are flapped by the air flow C5 as mentioned above can be prevented.

In this manner, the third embodiment can also demonstrate the similar effects as the foregoing embodiments.

Figure 23:
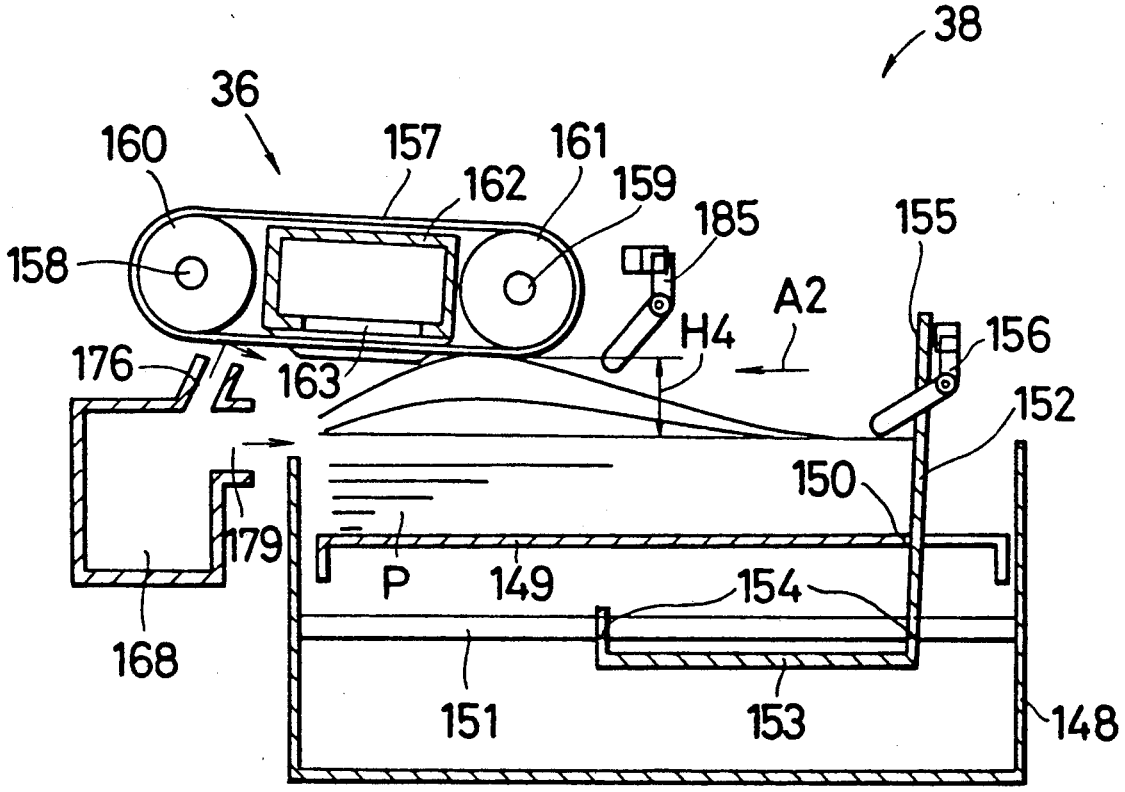
FIG. 23 is a side view illustrating a paper feeder 38 having a basic configuration of other embodiments of the invention.
Figure 24:
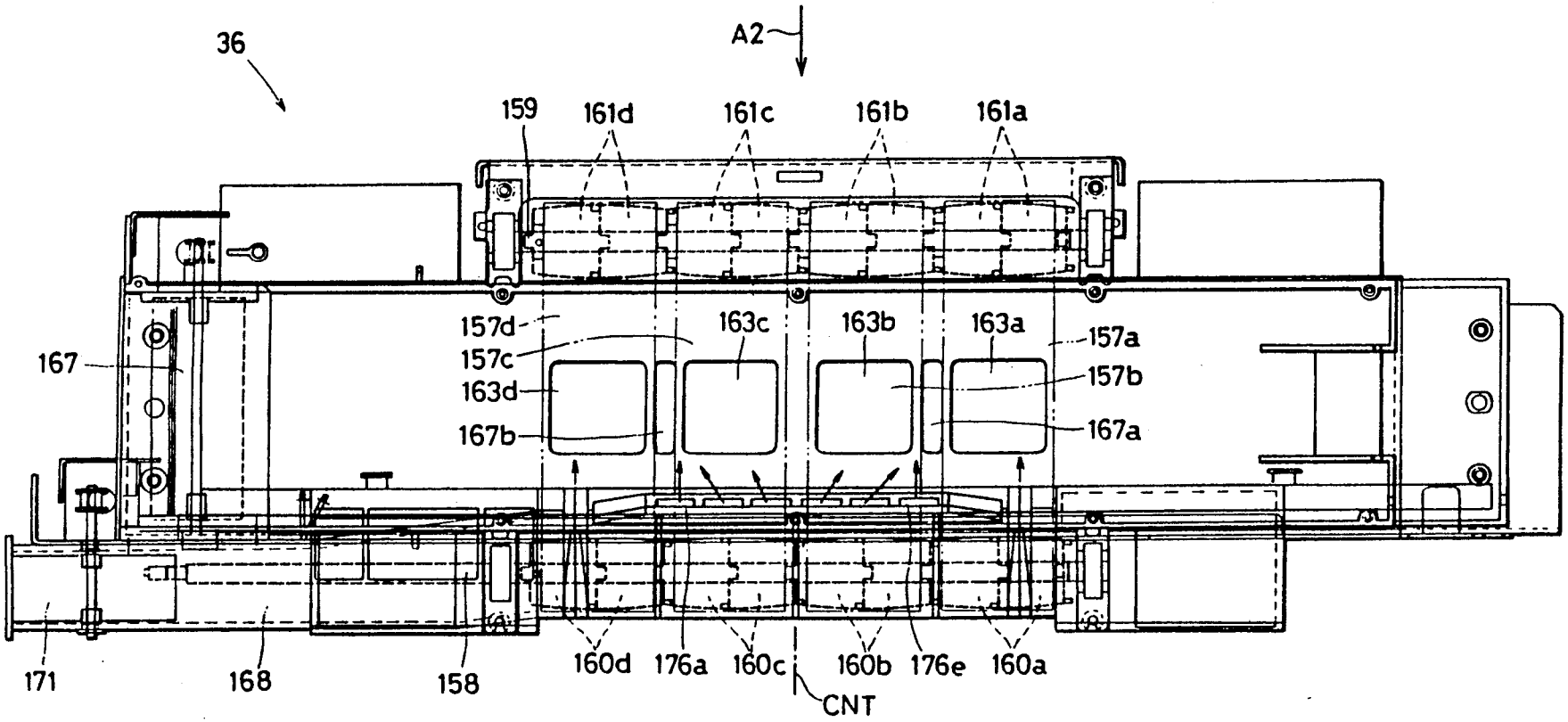
FIG. 24 is a plan view illustrating the periphery of a feeding stretching belt 157 in the paper feeder 38.
Figure 26:
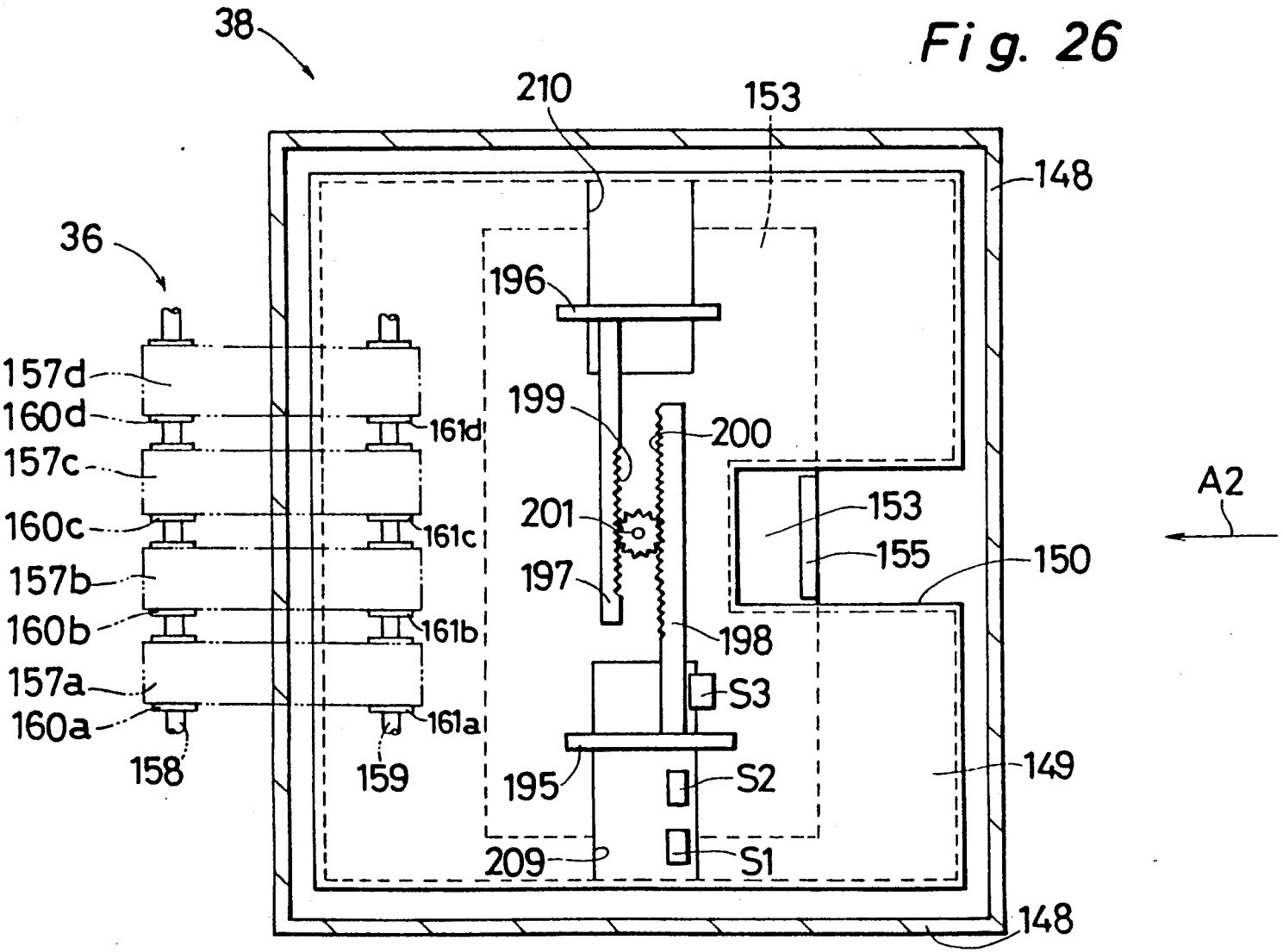
FIG. 26 is a plan view illustrating a paper width detector mechanism 135 in the paper feeder 38.

FIG. 23 is a side view showing a section of a paper feeder 38 in a copying machine 22 of another basic configuration of this invention, FIG. 24 is a plan view of FIG. 23, FIG. 25 is an exploded perspective view of the paper feeder 38, and FIG. 26 is a simplified plan view of the paper feeder 38. Referring now to these drawings, the constitution of the paper feeder 38 is explained below. The other paper feeders 39, 40 are composed alike. Below description is an explanation regarding a basic configuration of a fourth embodiment of the invention in FIG. 36A mentioned later. Meanwhile, the constituent elements of the paper feeder in this embodiment are similar to the constituent elements in the paper feeder 21 in the foregoing embodiments, except that this embodiments relates to the top-taking structure while the paper feeder 21 is of so-called bottom-taking top-returning structure.

The paper feeder 38 comprises a frame body 148 in which recording papers are stacked and stored, and a feeding unit 220 for separating and feeding one by one the recording papers stacked and stored in the frame body 148, and the frame body 148 incorporates a laying plate 149 being driven vertically by a lifting mechanism mentioned below on which recording papers P are stacked up. The laying plate 149 has a slot 150 extending in the feeding direction A2, and a guide rail 151 extending along the feeding direction A2 is formed beneath the laying plate 149. This guide rail 151 is provided with a mounting part 153 of a rear end defining member 152, slidably in the longitudinal direction, through plural insertion holes 154 in the mounting part 153. The rear end defining member 152 is provided with a defining part 155 extending above the laying plate 149 through the slots 150 of the laying plate 149 disposed in the mounting part 153. At a predetermined position of the defining part 155, an upper limit sensor 156 such as limit switch is provided, and when an excessive recording paper P is put on the laying plate 149, it is detected.

At a position predetermined with respect to the laying plate 149 of the machine body of the copying machine 22, an upper limit switch 185 realized, for example, by a limit switch is provided, and it is detected that the top recording paper P1 of the recording papers P stacked up on the laying plate 149 has a predetermined gap of H4 to the feeding stretch belt 157. That is, when the top recording paper P1 approaches abnormally, exceeding the distance of H4 to the feeding stretch belt 157, the upper limit sensor 185 is actuated to stop elevation of the recording paper.

The paper feeder 36 is provided with, for example, four feeding stretch belts 157*a* to 157*d* at predetermined positions with respect to the frame body 148. These feeding stretch belts 157*a* to 157*d* are stretched respectively on the rollers 160*a* to 160*d*; 161*a* to 161*d* fixed on the rotary shafts 158, 159. Between the rollers 160 and 161, a vacuum attracting box 162 is stored, which comprises a main body 164 forming attracting ports 163*a* to 163*d* opposite to the feeding stretch belts 157*a* to 157*d*, and a cover body 165 covering the main body 164. A damper 166 is contained in the vacuum attracting box 162, and a vacuum source (not shown) to which the vacuum attracting box 162 and the vacuum attracting box 162 are communicated/shut off. The attracting box 162 is supported by a support member 260 fixed on the frame body 148. Between attracting ports 163*a*, 163*b* and the attracting ports 163*c*, 163*d* of the main body 164, protrusions 167*a*, 167*b* extending along the feeding direction A2 and projecting downward are formed, and they project downward from between the feeding stretch belts 157*a*, 157*b*, and feeding stretch belts 157*c*, 157*d*.

At the downstream side of the feeding direction A2 of the frame body 148 and beneath the feeding stretch belt 157, a nozzle member 168 is provided. The nozzle member 168 contains the main body 169 and cover body 170, and a damper 171 is included in an internal air passage 216, thereby communicating/shutting off the blower (not shown) and the nozzle member 168.

The laying plate 149 in the frame body 148 is provided with slots 209, 210 along the widthwise direction, and lateral end defining plates 195, 196 are inserted from top to bottom of the laying plate 149. Near the rear side end of the laying plate 149 of the lateral end defining plates 195, 196, one longitudinal end of the driving members 197, 198 extending along the widthwise direction is fixed. At the mutually confronting end parts along the feeding direction A2 of the driving members 197, 198, racks 199, 200 are formed, and these racks 199, 200 are engaged mutually from the opposite sides with a pinion 201 rotatably disposed on a support plate 149 disposed between the driving members 197, 198.

Regarding the lateral end defining plate 195, a widthwise displacement position is detected, for example, by three positions sensors S1, S2, S3 which are disposed from outward to inward in the widthwise direction. The lateral end defining plates 195, 196 cooperate with each other by means of the racks 199, 200 and pinion 201, and by aligning the distance of the lateral end defining plates 195 in the widthwise length of the stored recording papers P, the widthwise length of the stored recording papers can be detected on the basis of the output from the position sensors S1 to S3.

Figure 27:
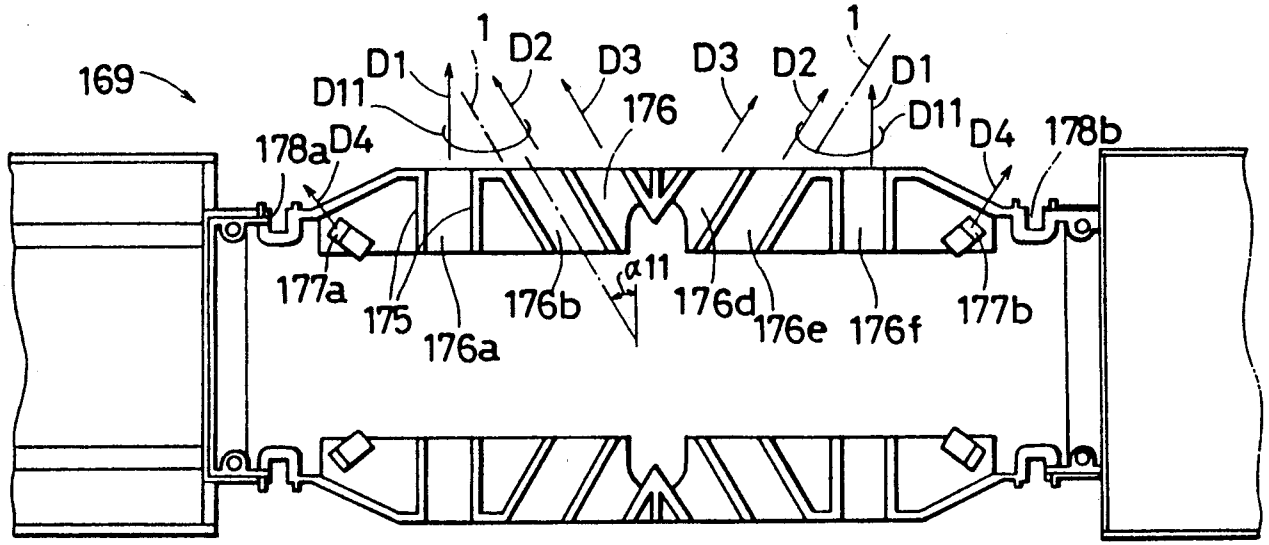
FIG. 27 is a front view of a main body 169 of a injection duct 168.
Figure 28:
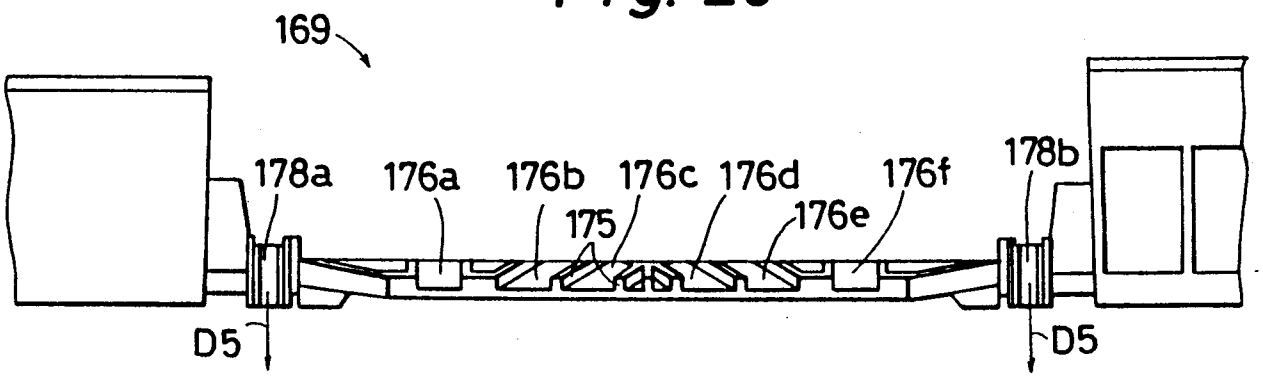
FIG. 28 is a front view of the main body 169.
Figure 29:
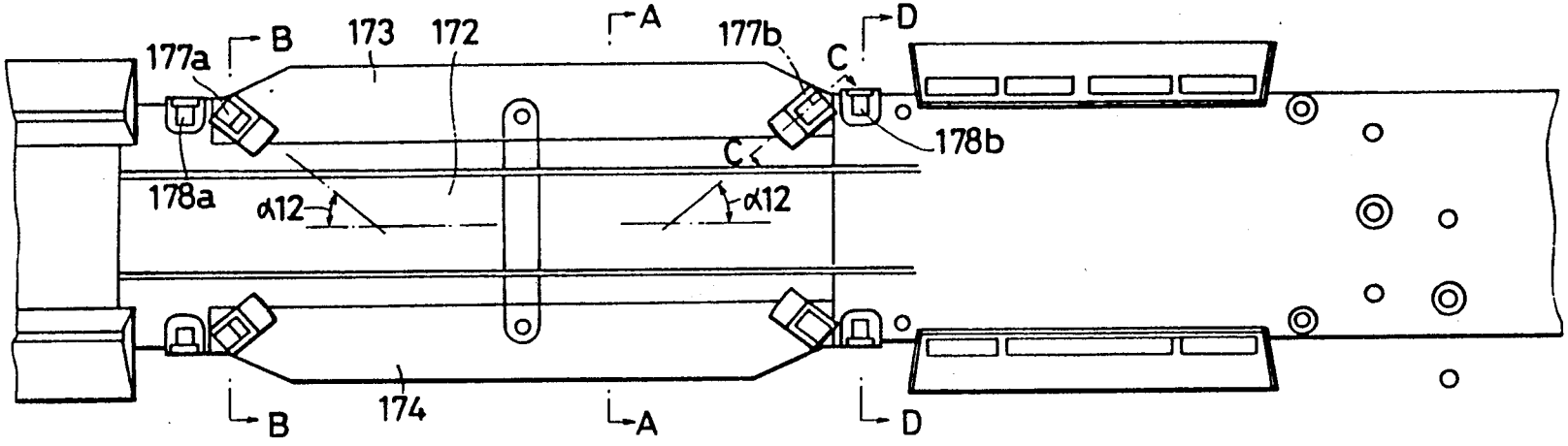
FIG. 29 is rear elevation of the main body 169.

FIG. 27 is a front view of the main body 169, FIG. 28 is a plan view of the main body 169, FIG. 29 is a back view of the main body 169, and FIGS. 30 to 33 are sectional views seen from the sectional lines A—A, B—B, C—C, D—D in FIG. 29. Referring together to these drawings, the composition of the nozzle member 168 is described in detail below. The main body 169 comprises a flat plate 172 extending in the widthwise direction, and slopes 173, 174 consecutive to the vertical direction thereof and inclined by an angle $\theta 3$ (e.g. 20 degrees) to the main body 148 side. At the downstream side of the feeding direction A2 of the slopes 173, 174, plural guide pieces 175 are formed, and when the cover body 170 is put on the main body 169, nozzle holes 176*a* to 176*f* forming the same jet flows D1 to D3 as the jet flows C1 to C3 by the nozzle 96 in the foregoing embodiment are formed by the adjacent guide pieces 175, and the nozzle is composed of the nozzle holes 176*a* to 176*f* and the adjacent guide pieces 175.

The nozzle holes 176*a*, 176*f* form a jet flow of arrow D1 toward the feeding stretch belt 157, in the vertical plane parallel to the feeding direction A2. The nozzle holes 176*b*, 176*f* have an angle of α11 (e.g. 30 degrees) to the feeding direction A2 in a plan view, and form a jet flow expressed by arrow D2 directed to the feeding stretch belt 157. The nozzle holes 176*c*, 176*d* form a jet flow and an air flow parallel to the arrow D2 and indicated by arrow D3. The jet flows D1, D2 are converged and synthesized on the central line 11 to form an air flow D11. In the lower stretched part 215 of the feeding stretch belt 157, the flow is injected to the position remote to the downstream side by the predetermined distance L5 from the downstream side end part of the feeding direction of the recording paper attracted so as to cover the attracting region 108 defined by the attracting vacuum box 162 and the range exceeding to the downstream side of the feeding direction A2. The reflected air flow from the feeding stretch belt 157 is blown and injected between the top recording paper P1 and the second recording paper P2. The injected air flow is inflated in the vertical direction, thereby separating the recording papers P1, P2.

Figure 32:
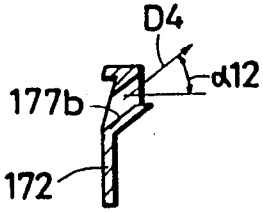
Figure 31:
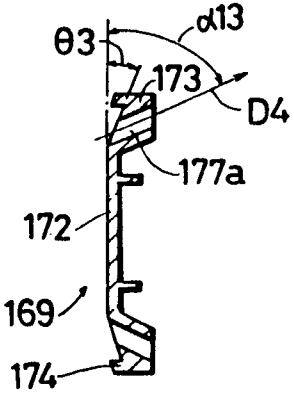

Further outward of the nozzle holes 176*a*, 176*f* of the main body 169, there are formed nozzle holes 177*a*, 177*b* having the sectional shapes as shown in FIGS. 31 and 32. The nozzle holes 177*a*, 177*b* are composed at an inclination outward in the widthwise direction as going upstream in the feeding direction at an angle of α12 (e.g. 40 degrees) with respect to the widthwise direction as shown in FIG. 29 outward in the widthwise direction, and are composed at an inclination to the upstream side of the feeding direction A2 as going from downward topward by an angle of α13 (e.g. 65.7 degrees) from the vertical direction as shown in FIG. 36.

Figure 33:
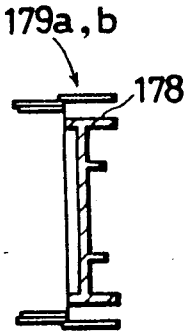
FIGS. 30 to 33 are respectively cross sectional views of the main body 169 taken along the lines A—A, B—B, C—C, and D—D in FIG. 29.

That is, to the upstream side of the feeding direction A2 than the jet flow of the nozzle holes 176*a* to 176*f*, the jet flow and air flow are injected as indicated by arrow D4. Further outward in the widthwise direction from the nozzle holes 177*a*, 177*b* of the main body 169, grooves 178*a*, 178*b* parallel to the feeding direction A2 are formed as the sectional shape is shown in FIG. 33. The grooves 178*a*, 178*b* are covered with the cover body 170 as shown in FIG. 33, and form a jet flow and an air flow parallel to the feeding direction A2 (indicated by arrow D5).

Figure 34:
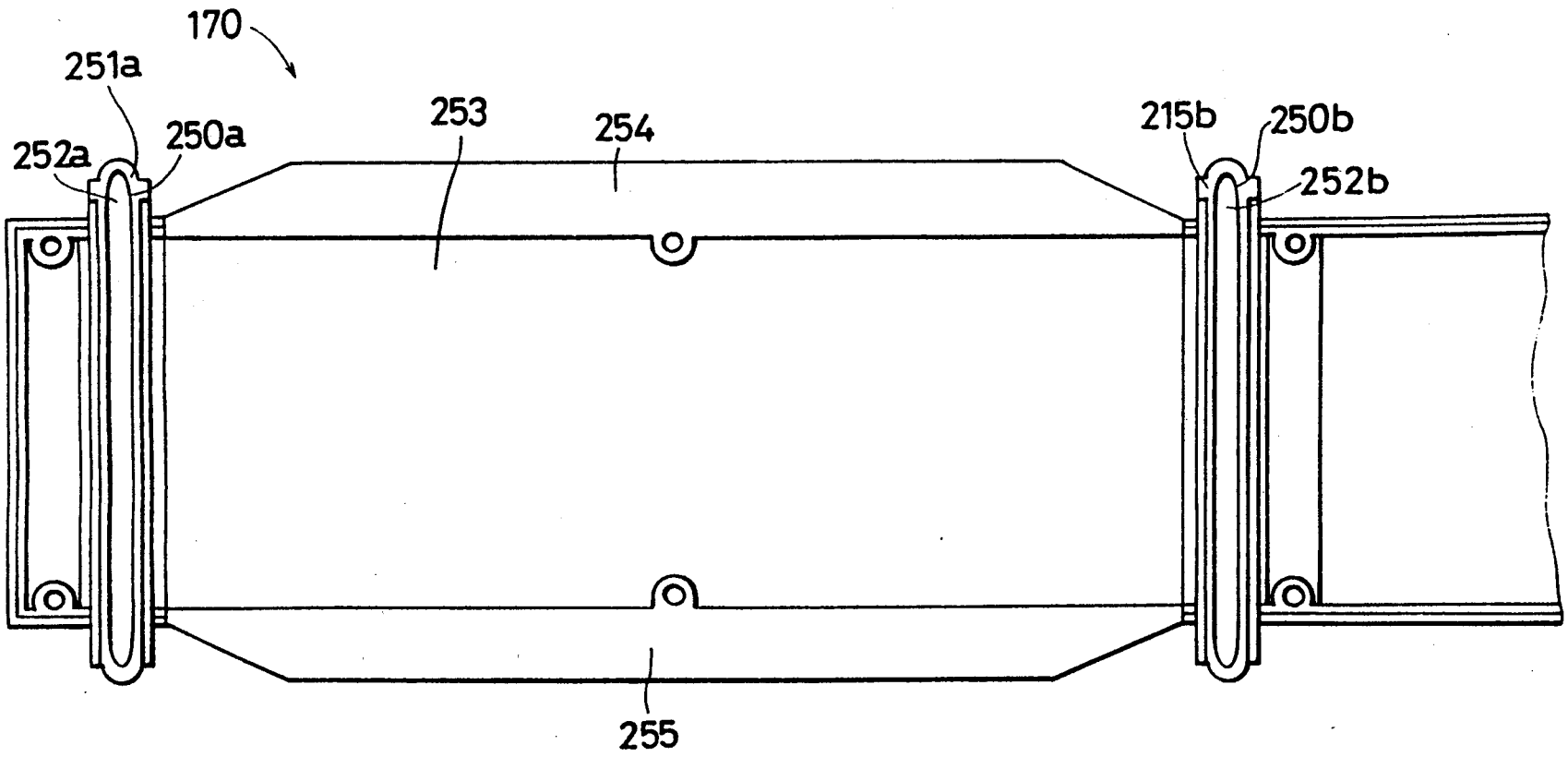
FIG. 34 is a front view of a cover body 170.

The cover body 170 shown in FIG. 34 is put on thus composed main body 169. At both sides of the cover body 170 in the widthwise direction, fitting projections 251*a* and 251*b* having a pair of upper and lower nozzle holes 252*a* and 252*b* are formed. These projections 251*a* and 251*b* are projected in the feeding direction A2, and the nozzle holes 252*a* and 252*b* are composed by the holes 250*a*, 178*a*; 250*b* and 178*b* in the state of being fitted to the grooves 178*a* and 178*b* of the main body 169. From these nozzle holes 252*a* and 252*b*, a jet flow may be formed in the direction of arrow D5 as shown in FIG. 33. A pair of upper and lower ribs 254 and 255 are integrally formed on the end plate 253 of such cover body 170, and by these ribs 254 and 255, the nozzle holes 176*a* to 176*e* are defined in the state of communicating in the direction of jet flows D1 to D3.

Figure 35:
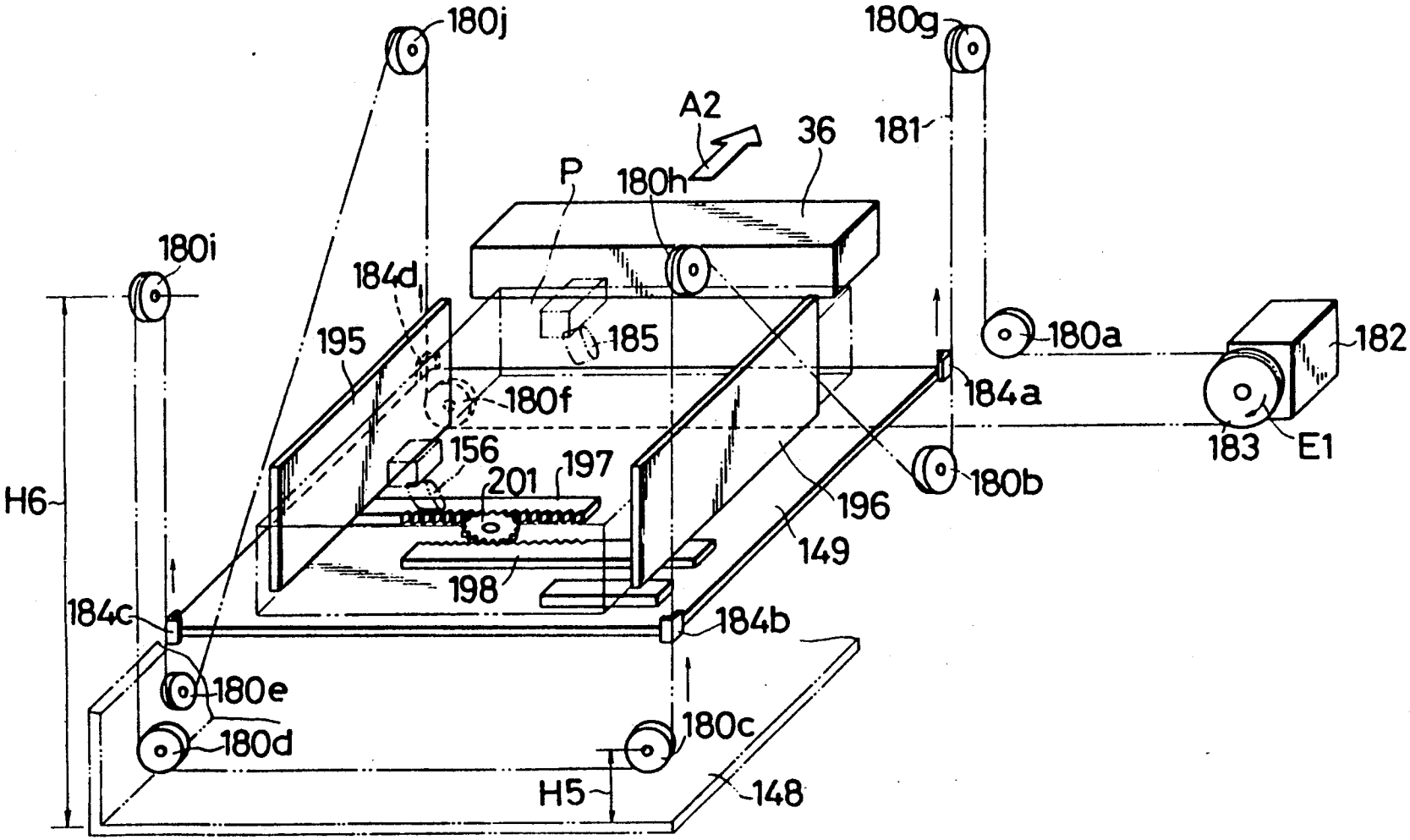
FIG. 35 is a flow diagram illustrating an elevating mechanism of a laying plate 149 in the paper feeder 38.

FIG. 35 is a perspective view showing the composition of elevating the laying plate 149 in the paper feeder 38. In the frame body 148, plural pulleys 180*a* to 180*f* are disposed as shown in the drawing at a predetermined height H5 from the bottom of the frame body 148, and pulleys 180*g* to 180*j* are disposed at a position of a predetermined height H6 from the bottom. A wire 181 is applied on these pulleys 180*a* to 180*j*, and the both ends of the wire 181 are wound around a driving roller 183 rotated by a pulse motor 182. In the portions stretching vertically at four corners of the frame body 148 of this wire 181, support pieces 184*a* to 184*d* from mounting the four corners of the laying plate 149 are fixed.

That is, when the driving roller 183 is rotated in the direction of arrow E1 by the pulse motor 182, the laying plate 149 is elevated, while the laying plate 149 is lowered. Thus, as shown in FIG. 23, the highest recording paper P1 in the vertical direction of the recording papers P put on the laying plate 149 is maintained at a position remote by a predetermined distance of H4 from the feeding stretch belts 157*a* to 157*d*. Consequently, a favorable vacuum attracting action of the top recording paper P by the feeding stretch belts 157*a* to 157*d* may be realized.

Figure 36A:
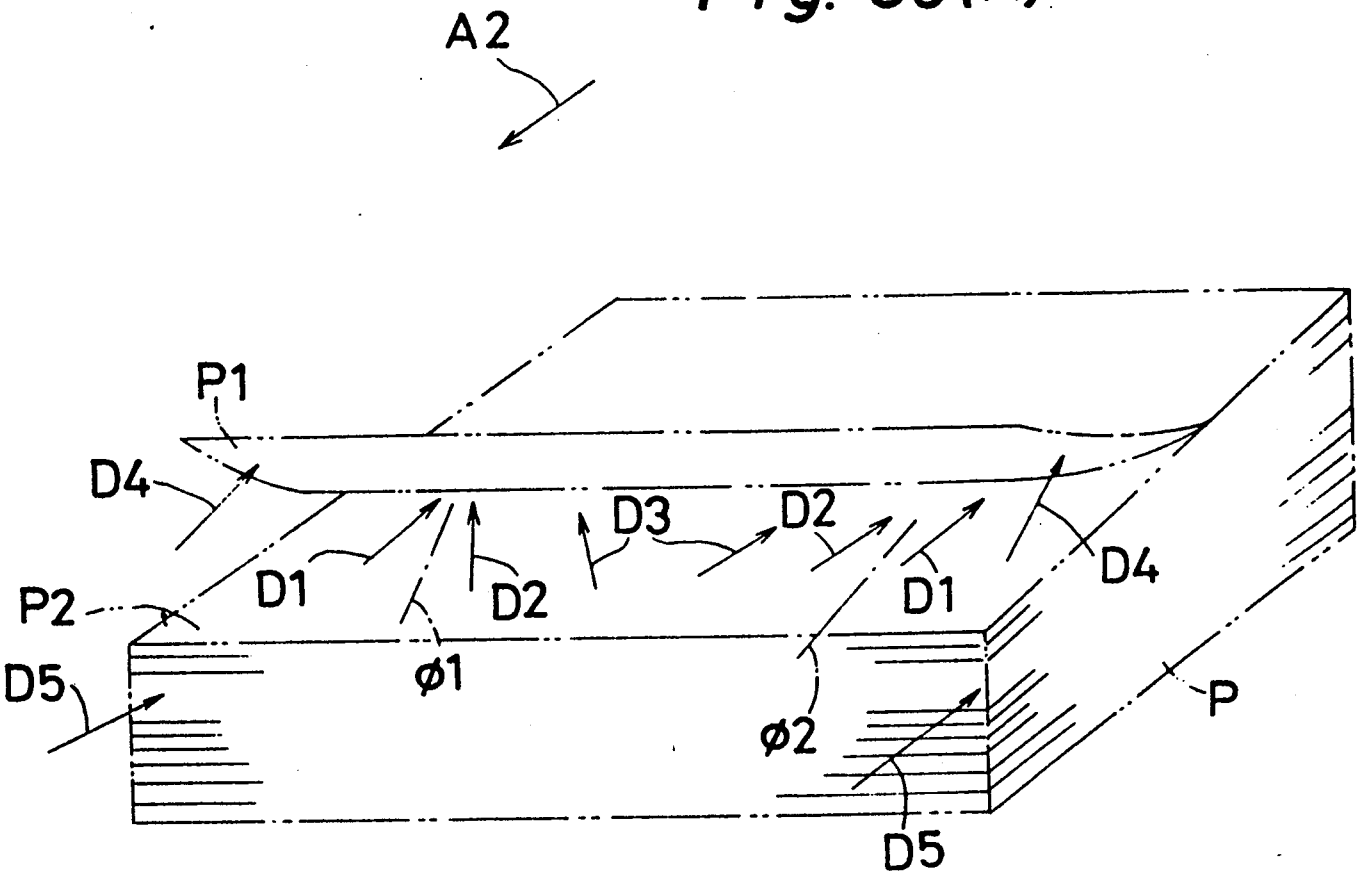
FIGS. 36A and 36B are perspective views illustrating an operation of the third embodiment.

FIG. 36(A) is a perspective view for explaining the basic function of each air flow indicated by arrows D1 to D5 and D11 from the nozzle holes 176*a* to 176*f*; 177*a*, 177*b*; 178*a* and 178*b*. The jet flows of arows D1 and D2 are concentrated as an air flow D11 in the widthwise direction of the recording paper P, and it is blown in and injected in the gap formed as shown below between the top recording paper P1 and the second recording paper P2, and is inflated in the vertical direction to separate the recording papers P1 and P2. The air flow indicated by arrow D3 also separates the recording papers P1 and P2 as mentioned below.

The air flow D5 from the nozzle holes 178*a* and 178*b* is an air stream injected parallel to the feeding direction A2 in the relatively upward portion of the stacked recording papers P, and it maintains a plurality of recording papers P near the upper part always in a lifted state. On the other hand, the air flow indicated by arrow D4 from the nozzle holes 177*a* and 177*b* pushes up the uppermost recording paper P1 of the plurality of recording papers P lifted by the air flow of arrow D5 to the feeding stretch belt 157 side, and the recording paper P1 is attracted in vacuum to the feeding stretch belt 157 by the negative pressure by the vacuum attracting box 162. At this time, in order that the plural recording papers P may not be attracted at the same time, the recording papers P are separated by the air flows indicated by arrows D11 and D3.

Figure 36B:
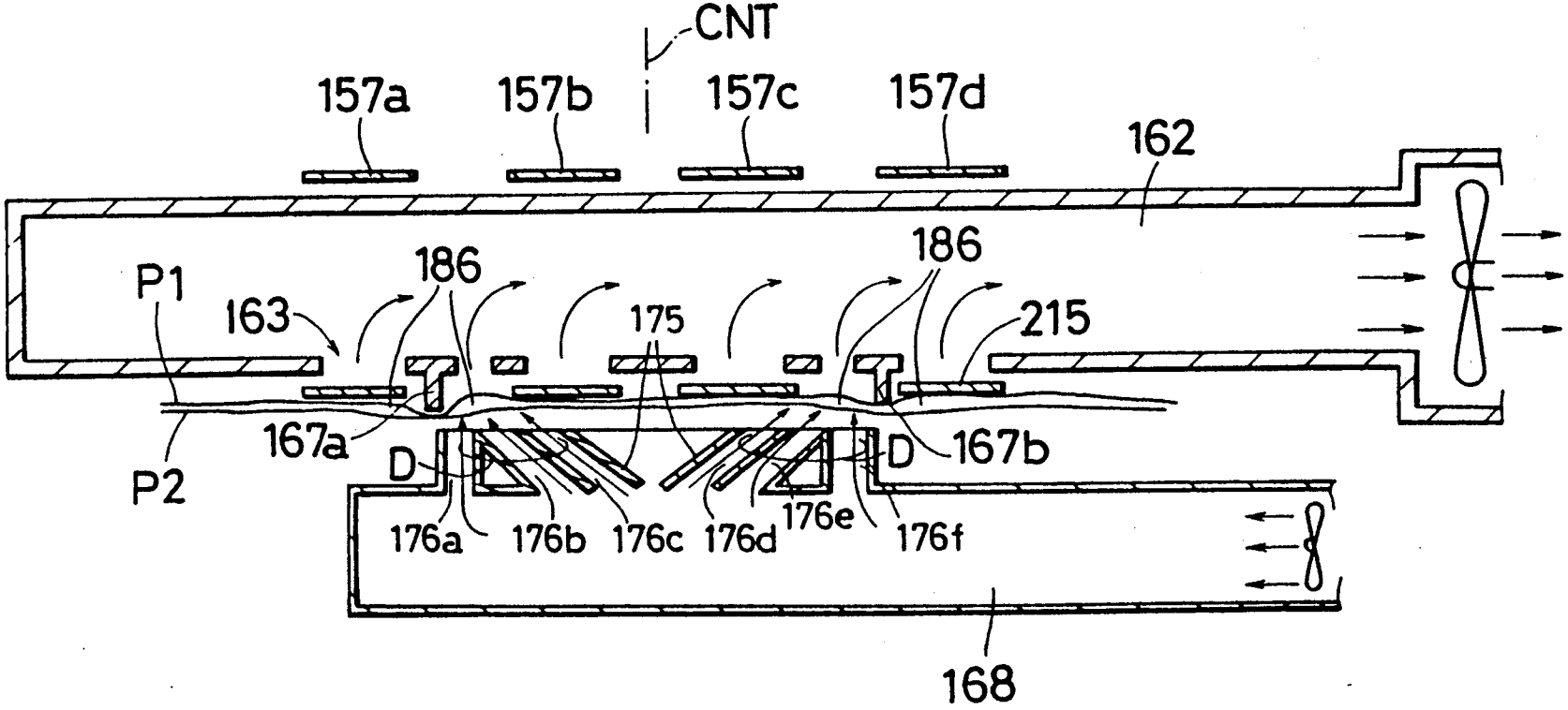

FIG. 36(B) is a sectional view explaining the separating action of the recording papers P in the paper feeder 38. For the sake of simplicity of explanation, the structure is shown in a simplified form in FIG. 36(B). Hereinafter, the nozzle holes 176*a* to 176*f* and the guide pieces 175 for defining them are collectively called a handling nozzle and indicated by same reference number. Besides, the nozzle holes 177*a*, 177*b*; 179*a* and 179*b* and guide pieces 175 for defining them are called pushing nozzle and lifting nozzle, respectively, and indicated by same reference numbers. As shown in FIG. 23 and FIG. 36(A), when the air flow indicated by arrow D5 is injected from the lifting nozzle 179 of the nozzle member 168 to the recording papers P stacked up on the laying plate 149, the relatively upper recording papers of the stacked recording papers P are lifted within the frame body 148.

At this time, when a negative pressure is generated in the vacuum attracting box 162, the floating recording papers P are attracted vacuum to the lower stretching part 215 of the feeding stretch belt 157. The top recording paper P1 at this time is attracted in vacuum to the lower stretching part 215 of the feeding stretch belt 157 while being lifted by the protrusions 167*a*, 167*b* projecting downward from within the feeding stretch belt 157, being formed in the vacuum attracting box 162. The second recording paper P2 is prevented from being attracted to the feeding stretch belt 157 because almost entire portion of the lower stretched part 215 of the feeding stretch belt 157 is covered by the recording paper P1. If attracted, it is only relatively weakly attracted. Accordingly, as shown in FIG. 36, a gap 186 is produced between the recording papers P1 and P2, near the protrusions 167*a* and 167*b*.

The air flow D from the handling nozzles 176*a* to 176*f* collides against the portion not opposing the attracting port 163, once at the feeding stretch belt 157, as mentioned above, and its reflected flow is injected between the recording papers P1 and P2. Therefore, the air flow injected downward in the gap 186 is inflated in the vertical direction, and the recording papers P1 and P2 are separated by this positive pressure. The air flow in the direction of arrow D3 from the handling nozzles 176*c* and 176*d* is attracted into the gap 186, and realizes the same separating action. The pushing nozzles 177*a* and 177*b* are to lift one or plural recording papers P of the uppermost area of the floating recording papers P to the feeding stretch belt 157 side.

In this embodiment, too, air flows C11 and C3 inflating in the vertical direction are formed at symmetrical positions about the widthwise central position CNT of the recording paper, and a satisfactory separating action is realized whether the recording papers P being used are relatively large or small in size. What is more, the air flow from the nozzle member 168 is concentrated in the widthwise plural positions to the recording papers P, and if the recording papers are relatively small in size or weight, scattering of the recording papers P by the air flow from the handling nozzles 176*a* to 176*f* without being attracted to the feeding stretch belt 157 may be avoided. Besides, although the air flow from the handling nozzle 176*e* is directed from inward to the outward side in the widthwise direction, this air flow is blocked by the air flow from the handling nozzles 176*a* and 176*f*, and leakage from both ends of the widthwise direction of the recording papers P may be prevented. Hence, it is possible to avoid flapping of the both ends in the widthwise direction of the recording papers P, disturbance of stacked state, or generation of noise.

Figure 37:
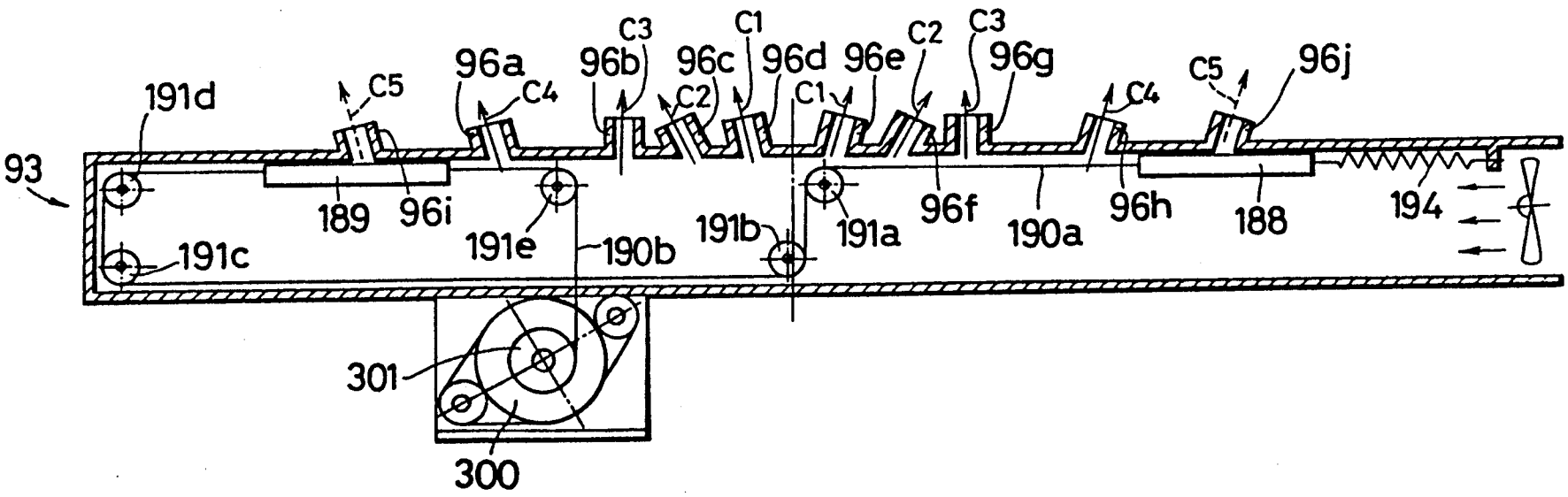
FIG. 37 is a cross sectional view illustrating an explanatory configuration of a fourth embodiment of the invention.
Figure 38:
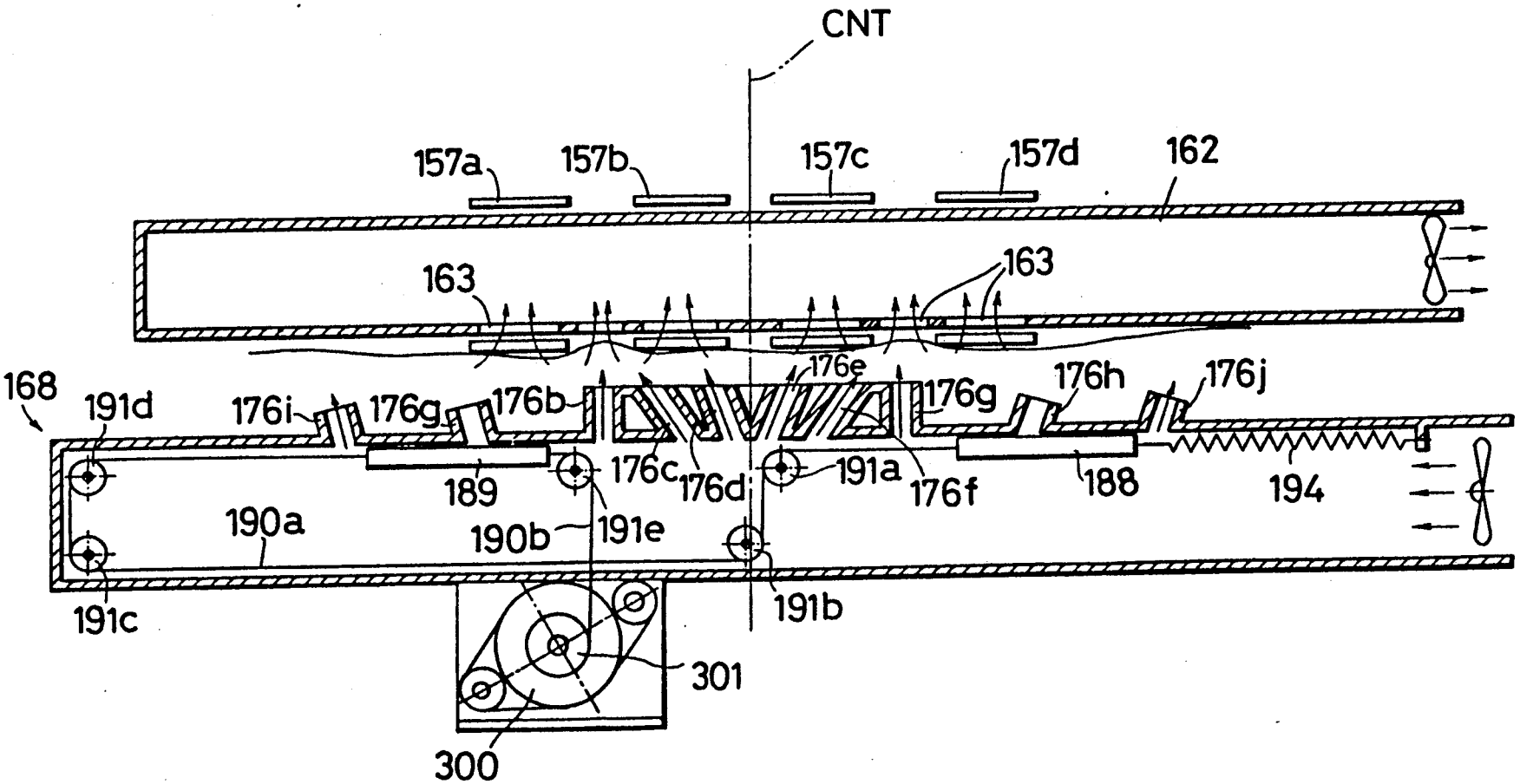
FIG. 38 is a cross sectional view illustrating an explanatory configuration of a fifth embodiment of the invention.

FIG. 37 is sectional view showing another constituent example of the nozzle member 168 in the paper feeder of a fourth embodiment of the invention, and FIG. 38 is a cross sectional view illustrating an explanatory configuration of a fifth embodiment of the invention. This embodiment is similar to the foregoing embodiments, and the corresponding parts are identified with the same reference numbers. In this embodiment, too, the valve 188 and 189 are arranged in the nozzle member 168 in the same configuration as in the preceding embodiment, and the wire 190*a* mutually connects the valve 188 and 189 through the pulleys 191*a* to 191*d*, and is connected to the lateral end defining members 195 through the pulleys 191*e*, 192*a* to 192*c*.

Figure 30:
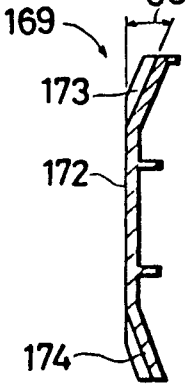

The lateral end defining members 195 and 196 are respectively fixed to the driving members 197 and 198 forming racks 199 and 200 at the mutually confronting sides as explained by reference to FIG. 30, and the racks 199 and 200 are engaged with the pinion 201 disposed between them mutually from the opposite sides. Therefore, the lateral end defining members 195 and 196 are interlocked with each other by the driving members 197 and 198, and pinion 201, and when the one side is moved outward in the widthwise direction manually, for example, the other side also moves outward in cooperation.

In the paper feeder 38 of the fifth embodiment having the nozzle member 168 thus constructed, the similar effects to the ones described with reference to the paper feeder 21 of the foregoing embodiment can be realized. More specifically, even in the case where the size of the recording paper P to be used in the copying operation varies from the relatively small size to the relatively large size, the paper feeder 38 having a single type of construction can be employed.

In the paper feeder 38 of the fourth embodiment, the valves 188, 189 are caused to close and open the nozzles 176*a* to 176*j* in accordance with the movement of the lateral end defining plates 195, 196 respectively. However, instead of such construction, it may be appropriate that the valves 188, 189 be made movable in both directions, as illustrated in FIG. 38, by the use of the driven pulley 301 or the like drivingly rotated by the motor 300 as illustrated with reference to the foregoing embodiment. In the fifth embodiment, the positions of the lateral end defining plate 195, 196 of the paper feeder 38 are manually set by the operator at the time of feeding the recording papers. As for the width of the air flows, the size of the recording paper is set in the copying operation and the valves 188, 189 are moved in accordance with the size of the recording paper to set the width of the air flow in the paper feeder 38 corresponding to the selected recording paper size.

Further in each of the foregoing embodiments, it may be appropriate that a plunger coupled to an electromagnetic solenoid or the like be used as a drive source to drivingly move the valves 188, 189. Moreover, in each of the foregoing embodiments, the recording papers are positioned with respect to the center position CNT. However, it may also be appropriate that the recording papers be positioned by the lateral ends thereof as another embodiment. In this embodiment, the similar effects to the ones explained in the foregoing embodiments can also be realized.

It should be appreciated that embodiments of the invention is not limited to a use in the copying machine for feeding the recording papers. The invention can be embodied in the wide range, for example, to feed the recording papers in the printer, and to feed the sheets other than recording papers.

It is understood by those skilled in the art that the foregoing description is a preferred embodiment of the disclosed device and that various changes and modifications may be made in the invention without departing from the spirit and scope thereof.

Further, this invention may be embodied in several forms without departing from the spirit of essential characteristics thereof. The invention is therefore illustrative and not restrictive, since the scope of the invention is defined by the appended claims rather than by the description preceding them.

Moreover, all changes that fall within meets and bounds of the claims, or equivalence of such meets and bounds are therefore intended to embraced by the claims.

What is claimed is:

1. A sheet feeding apparatus capable of feeding sheets of plural sizes comprising:

a laying plate having a centerline in a feeding direction for receiving a stack of a plurality of sheets;

sheet feeding means providing a feeding surface for vacuum feeding a sheet to be fed from the stack in a feeding direction, the feeding belt located adjacent the position of the sheet to be fed;

air flow forming means disposed downstream of the laying plate in the feeding direction for jetting a plurality of air flows across the laying plate and directed between the sheets in directions that are directed outwardly from the centerline of the laying plate in the feeding direction and in directions that are directed parallel to the feeding direction, the air flow forming means comprising a hollow nozzle member extending in a direction transverse to the centerline of the laying plate in the feeding direction and having a plurality of nozzles arranged along the length of the nozzle member; and air flow control means comprising movable valve bodies contained in the nozzle member for selectively controlling the rate of air flow of from one or more of nozzles that are at end portions of the nozzle member whereby the nozzles are opened and closed by the movement of the valve bodies.

2. A sheet feeding apparatus as defined in claim 1 wherein the sheet feeding means is disposed below the stacked sheets.

3. A sheet feeding apparatus as defined in claim 1 wherein the sheet feeding means is disposed above the stacked sheets.

4. A sheet feeding apparatus as defined in claims 1, 2, or 3 wherein the sheets feeding means comprising an endless belt encircling a vacuum attracting box having an opening faced to the sheets, being rolled on a pair of spacedly arranged rollers, and having a plurality of penetration holes.

5. A sheet feeding apparatus as defined in claim 1 wherein the air flow forming means having outer nozzles that direct air flows in directions outwardly from the centerline of the laying plate in the feeding direction.

6. A sheet feeding apparatus as defined in claim 5 wherein the air flow control means comprises two movable valve bodies.

* * * * *